US007186059B2

(12) United States Patent
Barnes

(10) Patent No.: US 7,186,059 B2
(45) Date of Patent: Mar. 6, 2007

(54) PADDING MACHINE AND METHOD OF USE

(76) Inventor: Tommy Barnes, P.O. Box 20, Flora Vista, NM (US) 87415

( * ) Notice: Subject to any disclaimer, the term of this patent is extended or adjusted under 35 U.S.C. 154(b) by 46 days.

(21) Appl. No.: 10/421,641

(22) Filed: Apr. 22, 2003

(65) Prior Publication Data

US 2004/0211092 A1 Oct. 28, 2004

(51) Int. Cl.
*E02F 5/22* (2006.01)

(52) U.S. Cl. ..... 405/175; 405/179; 37/142.5; 241/101.742

(58) Field of Classification Search ..... 405/174, 405/179; 37/142.5; 241/101.742, 101.763, 241/101.77
See application file for complete search history.

(56) References Cited

U.S. PATENT DOCUMENTS 4,539,765 A 9/1985 Reece
4,633,602 A 1/1987 Layh et al.
4,664,791 A 5/1987 McClain et al.
4,861,461 A 8/1989 Utterback
4,912,862 A 4/1990 Bishoip et al.
4,948,299 A 8/1990 Cronk, Jr. et al.
4,955,756 A 9/1990 Klamar
5,009,548 A 4/1991 Falbo et al.
5,084,991 A 2/1992 Cronk, Jr.
5,097,610 A 3/1992 Bishoip
5,120,433 A 6/1992 Osadchuk
5,195,260 A 3/1993 Osadchuk
5,259,699 A 11/1993 Klamar
5,261,171 A 11/1993 Bishop
5,271,168 A 12/1993 Wilson, Sr. et al.
5,292,006 A 3/1994 Girts, Jr.
5,363,574 A 11/1994 Osadchuk
5,421,108 A 6/1995 Stewart
5,430,962 A 7/1995 Osadchuk
5,479,726 A 1/1996 Bishop
5,540,003 A 7/1996 Osadchuk
5,694,709 A 12/1997 Cronk, Jr. et al.
5,741,087 A 4/1998 Osadchuk
5,765,967 A 6/1998 Klaymar
5,846,026 A 12/1998 Gilbert et al.
5,938,373 A 8/1999 Scudder
5,988,937 A 11/1999 Komoriya et al.
6,055,749 A 5/2000 Cronk, Jr.
6,125,558 A 10/2000 Stewart
6,158,925 A 12/2000 Schleining et al.
6,312,194 B1 * 11/2001 Simons ..... 405/179
6,318,930 B1 11/2001 Scudder
6,502,333 B1 * 1/2003 Striegel ..... 37/142.5

* cited by examiner

*Primary Examiner*—Thomas B. Will
*Assistant Examiner*—Tara L. Mayo
(74) *Attorney, Agent, or Firm*—Jones Day

(57) ABSTRACT

An integrated padding machine that incorporates a front digging auger that is preferably mechanically as opposed to hydraulically powered, which in conjunction with a breaker bar assembly provides for digging and crushing capabilities, and that incorporates several other improvements and advances, including screen and cross-pass conveyor level control, a real-time padding level monitoring system, and an assistant's control module, improved controls, dust control, and cold weather padding, and methods of using the machine.

10 Claims, 29 Drawing Sheets

84

90
82

52
54
50

80
86
82
257

16
90
80
258
91a
83
28a
80
258
258
258

80
88
90
80

FIG. 28B
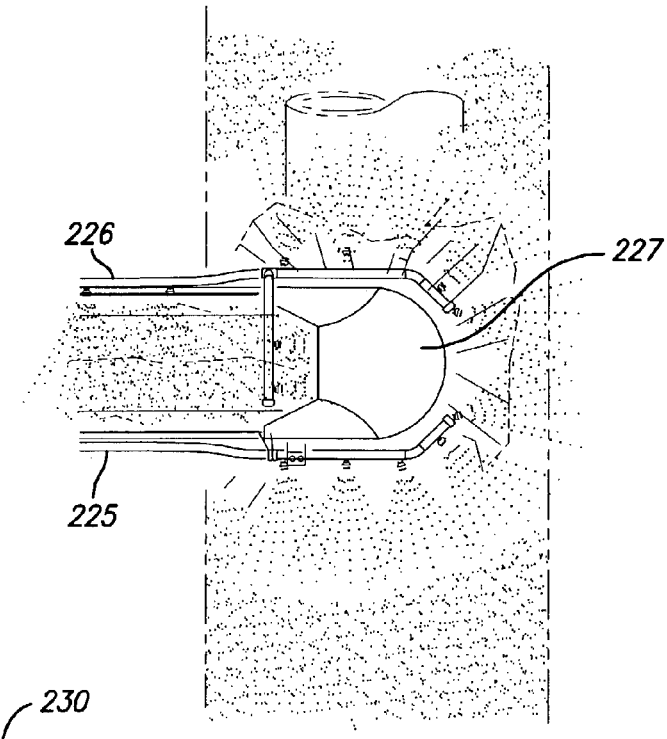
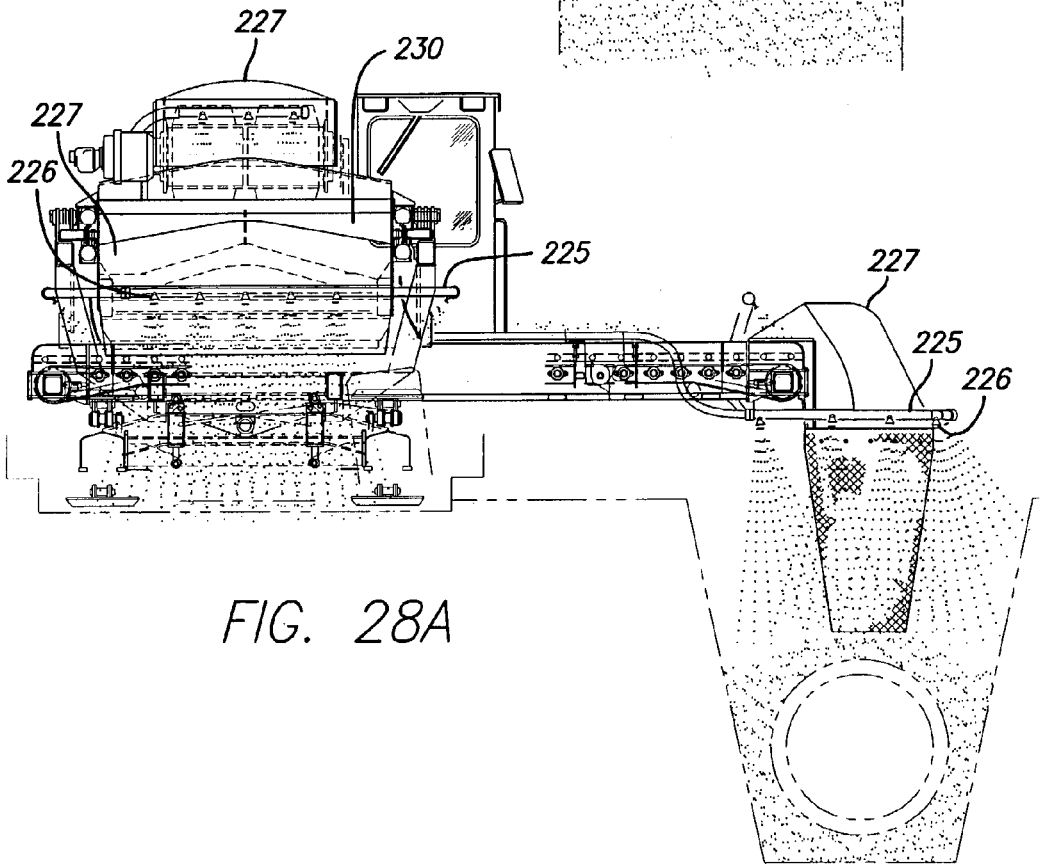
FIG. 28A

PADDING MACHINE AND METHOD OF USE

FIELD OF THE INVENTION

This invention relates to machines and method of their use for processing the already-excavated material from a trench, and returning the fine material extracted therefrom back into the trench to pad the pipe before the trench is completely refilled. In particular, this invention relates to a padding machine that incorporates digging and crushing capabilities among many other improvements, and thus can be used to more efficiently and expeditiously process the excavated material, and to do so effectively in varying terrains and under varying soil and climatic conditions.

BACKGROUND

Laying pipe underground uses the three basic steps that are involved in burying anything in the ground—1) dig the hole; 2) put the thing to be buried in the hole; and 3) file the hole back up again. But, the process of putting long expanses of pipe underground creates unique problems. These projects can involve trenches that are up to several feet deep and wide, and extend for literally hundreds or even thousands of miles over all types of terrain and through all types of soils, from soft loam to hard pan; from level ground to 45-degree grades; and in all sorts of climatic conditions, from hot, dry and dusty to freezing and wet.

The pipe can be up to 4 or 5 feet in diameter (and sometimes larger) and may be made of concrete or plastic or other material, and may carry water, or oil, or natural gas, or sewage, or electrical wires, or fiber optic cables, for just a few examples.

The pipe-laying process involves first using a large trenching device that creates the trench. These machines typically deposit the excavated material, called "spoil," along side the trench creating what is called the "spoil bank" or "spoil pile." The spoil bank can be five to six feet high at its center line, and eight to ten or more feet wide at its base. It will include both small grain dirt or sand, but also larger rocks and aggregates. Its exterior crust might even be frozen. It might include debris such as broken parts from a trencher, or wire, bottles and cans, or wooden or metal posts, or just about anything that might be found in or on the ground.

The next step in the overall pipe-laying process involves placing the pipe into the trench. Because a rupture of one of these pipes could have disastrous safety and environment consequences, it is extremely important that the pipe be as well protected as possible. This typically means that the pipe will not be laid directly on the ground in the trench, but on sand bags or other such cushioning and positioning devices. It also means that the pipe will often be covered or coated with a protective material to prevent corrosion.

The next step in the overall process is backfilling the trench. When the trench is back filled, it is desirable to first completely encase the pipe with a relatively fine, flowable, defined and uniformly-sized backfill material so that the pipe is equally and evenly supported. This material is referred to as "fines" in the industry. Partially backfilling the trench with fines is called "padding" the pipe. Sometimes, a plastic sheeting strip will be placed in the trench on top of the padding as a warning to anyone who might subsequently be digging in the area (they would encounter the warning strip first thus alerting them to the presence of the pipe below before doing damage to the pipe).

The last step—completely filling up the trench—presents environmental concerns as there is a desire, particularly on these long, cross-country pipe laying projects that often traverse undeveloped land, to leave the area as clean, neat and environmentally sound as possible.

Therefore, it has long been known that simply bulldozing the spoil back into the trench was not acceptable. Because the spoil will often include rocks or other aggregate material of one size or another, simply bulldozing the spoil bank back into the trench may damage the pipe or its protective cover or coating as the rocks fall directly on it. Also, the rocks or aggregate material may create an unwanted and dangerous pressure point on the pipe. Or they may "bridge" in the trench, preventing the backfill material from flowing under and around the pipe, thus creating an unevenly supported pipe that might be more susceptible to leaking or, worst, rupture. Lastly, just bulldozing the spoil back into the trench can leave an unsightly job site.

In the earliest days of long-expanse pipe laying, suitable backfill material, such as sand, was trucked to the site and used as the padding material. This proved inadequate for reasons of cost primarily. As in almost all, if not all, competitive commercial activities, cost is an incredibly important factor in this industry. These large, pipe-laying projects can cost millions, if not ten's or hundred's of millions of dollars. Ways to improve the padding process and to do so at less cost are constantly being explored, and it is not surprising that trucking in the fine padding material was not acceptable for very long. Therefore, the industry began to process the excavated material on-site to separate the fines that could be used to pad the pipe from the coarser material.

Some of the earliest machines to separate the fines from the coarser material were portable screening apparatuses (see, e.g., U.S. Pat. No. 3,439,806) that could be moved to the trench site. This required, however, that other equipment be used to bring the spoil to the screening apparatus, and to transport the fines back to the trench.

It was soon determined, however, that an integrated machine that could perform all of these steps; that is, picking up the spoil, delivering it to the screening apparatus, and then transporting the fines to the trench, leaving the coarser material behind, would be a marked improvement. One of the earliest such integrated machines is shown in U.S. Pat. No. 3,701,422, issued on Oct. 31, 1972 to Thomas A. Downey. It discloses what is essentially a converted large scale scraper. These large wheeled scrapers typically have a cutting blade that is intermediate of the front and back wheels on a long wheel-based vehicle, and is hydraulically raised or lowered by the driver to remove a layer of ground while the vehicle moves forward. The excavated dirt is stored in the large holding vessel immediately behind the cutting blade. When the holding vessel is full, the scraper travels to a predetermined area where it is unloaded, and the scraping process begins again. In the '422 patent, Downey converted the scraper into a padding machine by adding an "up" conveyor immediately behind the cutting blade in the space formerly devoted to the holding vessel in the scraper. The vehicle straddled the spoil pile next to the trench, and the cutting blade caused the spoil to be forced onto the up conveyor where it was carried to and dumped onto a screen. The fines fell through the screen onto a cross-pass conveyor which carried the fines back to the trench. The coarser material that would not fall through the screen fell onto a another cross-pass conveyor that deposited the coarse material back onto the ground on the side of the device opposite the trench. This device thus incorporated the three basic components of all integrated padding machines that have followed since—1) the up conveyor for elevating and transporting the spoil to (2) a screening assembly which allows the fines from the spoil to fall through the screen onto a (3) cross-pass conveyor that transports the fines back to the trench.

Since then, there has been a continuing effort to improve the padding machine and process. In terms of padding pipe, "improvement" can mean many things. For example, cost continues to be primary factor. This means speed, among other things. For example, large scale pipe-laying projects preferably want to lay at least one linear mile of pipe per day. That dictates that all of the processes—digging the trench, laying the pipe, and, as is important here, padding the pipe, must occur at that rate. The normal work day on a pipe-laying project is 10 hours. That means that the preferred padding machine must be able to pad at least 8.8 feet of pipe every minute. When the unavoidable down time for fueling, lubricating, cleaning screens, etc., is factored in, the preferred padding machine must be able to pad pipe at something greater than 8.8 feet per minute. That in turns means that the padding machine should be able to handle different terrains, different spoil bank contents, and different environment and weather conditions effectively and efficiently. It also means that the preferred padding machine must be able to extract from the spoil bank the maximum amount of fines possible. Padding specifications usually dictate that the padding material must extend above the highest point of the pipe by a minimum amount, usually six or more inches. It is therefore necessary that the padding machine be able to generate sufficient fines from the spoil bank to be able in turn to deliver the appropriate amount of fines back to the trench in a single pass at a sufficiently high rate of forward movement of the padding machine. As can be appreciated, if the padding machine must stop, reverse direction, and then re-pad an area, average forward speed is adversely affected.

In a nutshell, the padding operation prefers a padding machine that can consistently and uniformly deliver a high quality of fines, a high quantity of fines, and at a high rate of average forward speed.

As mentioned, the desire to improve the modern padding machine has continued literally unabated. Just since 1985, more than thirty U.S. patents have issued relating in one fashion or another to padding machines and the method for their use. For example, in U.S. Pat. No. 4,633,602, issued to Ricky Layh et al on Jan. 6, 1987, an integrated padding machine is disclosed that has the traditional up conveyor, screening assembly and cross-pass conveyor, but which claimed a novel adjustable "gathering head" at the leading end of the up conveyor that could be adjusted by the operator to gather more or less of the spoil bank.

In U.S. Pat. No. 4,912,852, issued to William B. Bishop et al on Apr. 3, 1990, a "Backfill Machine" is disclosed that includes the traditional up conveyor, screening assembly and cross-pass conveyor, and also includes a hydraulically powered front auger that assists in moving spoil onto the up conveyor. The auger, however, has no effective digging or crushing capability. The claimed novel aspect of the device disclosed in '852 is that the cross-pass conveyor is situated so as to redeposit the fines back into the trench at a point in front of the front auger.

In U.S. Pat. No. 4,948,299, issued to Thomas J. Cronk, Jr. et al on Aug. 14, 1990, a padding machine is disclosed which again includes the traditional up conveyor, screening assembly and cross-pass conveyor, in which the claimed novel aspects are multiple conveyors and screens to extract more fines from the processed spoil.

In U.S. Pat. No. 5,120,433, issued to Mark Osadchuk on Jun. 9, 1992, an improved padding machine, again having the traditional up conveyor, screening apparatus and cross-pass conveyor, is disclosed in which a pair of forwardly extending guide projections, each having a flat, planar, lower ground engaging surface, guide the spoil into and onto the up conveyor. (See also, related U.S. Pat. Nos. 5,195,260, 5,363,574, and 5,430,962, which all disclose a similar padding machine having the forward extending guide projections, some with rotary feeding wheels attached to the guide projections and other similar means for guiding the spoil into and onto the up conveyor, and having means for applying a downward pressure on the front guide means).

In U.S. Pat. No. 5,421,108, issued to Teddy L. Stewart on Jun. 6, 1995, a "High Volume Pipe Padding Machine" is disclosed that has the traditional up conveyor, screening assembly and cross-pass conveyor, and is designed to be attachable to the back of a standard bulldozer. The machine has a front cutting blade that can be raised or lowered by the operator to increase or decrease the amount of spoil being fed to the up conveyor. (See also, related U.S. Pat. No. 6,125,558).

And perhaps most recently, U.S. Pat. No. 6,318,930 B1, issued to Erik D. Scudder on Nov. 20, 2001, discloses a padding method and apparatus that has an adjustable "feeder housing" that extends forwardly of the up conveyor and a hydraulically-operated rotating drum that assists in breaking up dirt clods.

As this sampling of patents ably shows, the desire to improve upon the traditional padding machine continues, as there is an ongoing need in the art for a padding machine that produces a higher quality and quantity of fines, and does so efficiently, effectively and expeditiously, regardless of the terrain, soil, debris or climatic conditions encountered, and that presents minimal adverse impact to the terrain.

While these existing machines are all functional to a degree, none of them provides the advantages obtained by the machine herein disclosed and described. None of the prior art machines provides both effective digging and crushing capability by incorporating a true digging auger (i.e., one that is preferably mechanically driven rather than being hydraulically driven) previously used in road planers and the like, that not only acts to deliver the spoil to the up-conveyor as in prior art machines, but also digs and crushes to produce a higher percentage of fines. Many of the prior art devices have one means or another for introducing the spoil to the up-conveyor, but they do not do so in the same way and with the same result as does the machine of this invention. For example, in the device shown in the '433 patent (and its related patents noted above), the forwardly extending guides that are used to guide the spoil onto the up conveyor actually have a tendency to create dirt clods if there is any moisture in the spoil. Those dirt clods are simply passed through the machine, thus diminishing the production of fines instead of enhancing it. Not only does the machine of this present invention not create dirt clods, but with the combination of the digging auger and breaker bar, it breaks apart the dirt clods and grinds aggregate material that are already present in the spoil pile.

None of the prior art machines can effectively pad pipe at a 45 degree up-grade; none of the prior art machines constantly monitors the amount of padding so that the operator can ensure that enough but not too much padding is being added to the trench; none of the prior art machines provides truly enhanced operational control; none of the prior art machines can be effectively used in freezing conditions; none of the prior art machines provide screens that can be effectively used with wet and grassy spoil; and none of the prior art machines provides means for effective dust control or for padding in freezing conditions. There exists a need in the art for an improved padding machine that can do all of these things and more, which is what is provided by the invention hereinafter described and claimed.

SUMMARY OF INVENTION

The preferred embodiment of the padding machine hereinafter disclosed and claimed presents numerous improvements and advancements to the traditional padding machine that incorporates the traditional up conveyor, screening assembly and cross-pass conveyor.

First, the padding machine of this invention replaces the usual front feed or guide assembly which the prior art machines use to feed or guide the spoil to the up conveyor with a digging auger that is preferably mechanically (as opposed to hydraulically) operated, and a breaker bar assembly in front of the up conveyor. The preferred front digging auger is the type now used on road planers (such as the Caterpillar PR1000 Cold Planer). It has carbide teeth around the periphery of its flights such that the auger simultaneously digs and conveys the dug material to the center of the auger where it is fed to the up conveyor. Therefore, the front digging auger of this invention provides the dual role of digging into the spoil pile (and into the earth under the spoil pile if desired) and guiding or feeding the spoil (and any dug earth) onto the up conveyor. This provides much improved consumption of the spoil pile, regardless of the condition of the pile (such as being partially frozen due to freezing ambient temperatures). It also provides a crushing capability in that the digging auger (which will operate at high revolutions per minute thus providing significant torque) starts to break the aggregate material in the spoil pile down to fines immediately. Large aggregate material that is not immediately broken into its component parts will be crushed between the auger and the breaker bar, or held against the breaker bar and systematically ground into smaller fines by the continuous grinding action of the carbide teeth on the auger.

Because of this direct drive digging auger system, the power train from the engine to the auger will include a transmission, and two different types of clutches—a "lock up" torque converter and a spring set slip clutch. The lock-up torque converter can be selectively engaged and varied by the operator so as to provide infinite control over the amount of torque being applied to the digging auger at any time. The engine that provides the power source for the digging auger, the motive force for the padding machine, and the hydraulic power to position the auger frame assembly and to operate the track system, the up-conveyor, the screen assembly and the cross-pass assembly, is situated to the left of the operator. This provides improved visibility and balance as opposed to those prior art machines that have included the engine on top of the front assembly (i.e., as in U.S. Pat. No. 5,363,574).

The entire auger frame assembly of this invention can be raised or lowered and tilted forward and back so as to increase or decrease the amount of spoil being consumed, and in areas where using the virgin earth under the spoil pile is appropriate, the digging auger can actually be lowered and so positioned as to not just consume the spoil pile but also to dig a predetermined amount of the underlying soil, thus improving the generation of fine material and leaving an exceptionally clean and level area adjacent to the trench.

Second, the padding machine of this invention incorporates an improved up-conveyor designed to avoid damaging blows from material that is presented to it by the front digging auger.

Third, the padding machine of this invention incorporates leveling means whereby the screening assembly and the cross-pass conveyor can be rotated relative to the vertical/horizontal axis so that the screening assembly and cross-pass conveyor are maintained at an optimal angle regardless of the grade of the terrain encountered. As is well-known in the screening art, screens have a preferred angle relative to the vertical or horizontal axis so that the maximum amount of fines will fall through the screen while the coarser material is forced by gravity to fall off of the screen. Long distance pipe-laying projects almost always involve terrain that is not level, and sometimes encounter and must traverse areas where the grade can be up to 45 degrees. The padding machine of this invention can accommodate a 45-degree up-grade and still maintain the screen assembly in its optimal angle and the cross-pass conveyor level so that the maximum amount of the fines are still being extracted and delivered to the trench. The padding machine of this invention can also accommodate significant side-hill slopes as well, all the while keeping the operative components level.

Fourth, the padding machine of this invention incorporates means for constantly measuring the level of padding in the trench and communicating that information on a real time basis to the operator and the on-site owner's inspector so that the operator can constantly adjust the padding machine's speed (or it can be adjusted automatically) to ensure sufficient padding is being added to the pipe. In existing padding operations, an assistant usually walks immediately behind the padding machine, using a physical probe to determine if there is enough padding on top of the pipe. If he or she discovers too little padding at any point, the padding must be increased. This is an after-the-fact determination, however, so it means that if insufficient padding is detected the padding operation has to stop, the padding machine reversed, and that area given additional padding. This causes unacceptable delay. On the other hand, going too slow such that too much padding is added to the trench is also not desired. This too is avoided with the device and method of this invention.

Fifth, the padding machine of this invention incorporates a separate control for the operator's assistant. In the traditional padding machine, the single operator in the cab or driver's seat of the machine controls all functions of the machine. In this invention, however, a separate controller, preferably a wireless controller, is provided so that it can be hand carried by the assistant who walks along side the padding machine. This person, using that controller, will be able to adjust the speed and position of the cross-pass conveyor, among other functions. The assistant will also have a "kill" switch so as to stop the entire machine if need be.

Sixth, the screen assembly is attached to a frame that is mounted on four pneumatic wheels that rest against the main frame of the padding machine. The air pressure in the tires can be constantly monitored and adjusted to in turn adjust the degree of stroke of the screens.

Seventh, the operator of the device is provided with "joystick" controls for the tracks and the front auger assembly, allowing for control of these two important aspects in a very controlled, infinitely variable way. This greatly improves the operability of the device.

Eighth, the machine is equipped with a dust control system that will allow it to operate effectively in very dusty conditions.

Ninth, the machine is equipped with a heating system that allows it to operate effectively in freezing temperatures.

Other improvements and advantages will be apparent to those skilled in the art from the Figures, description and claims set forth below.

DESCRIPTION OF THE FIGURES

FIGS. 12D, E, and F are partial end views; FIG. 12G is a partial side view and FIG. 12H is an isolation view of the armor plate.

FIG. 27 is a schematic showing the main components of the dust control system. FIGS. 28A, B and C are a rear view and partial top views, respectively, of the machine with the dust control system in operation, and also showing some of the heating hoods in place.

DETAILED DESCRIPTION OF THE PREFERRED EMBODIMENT

Figure 1:
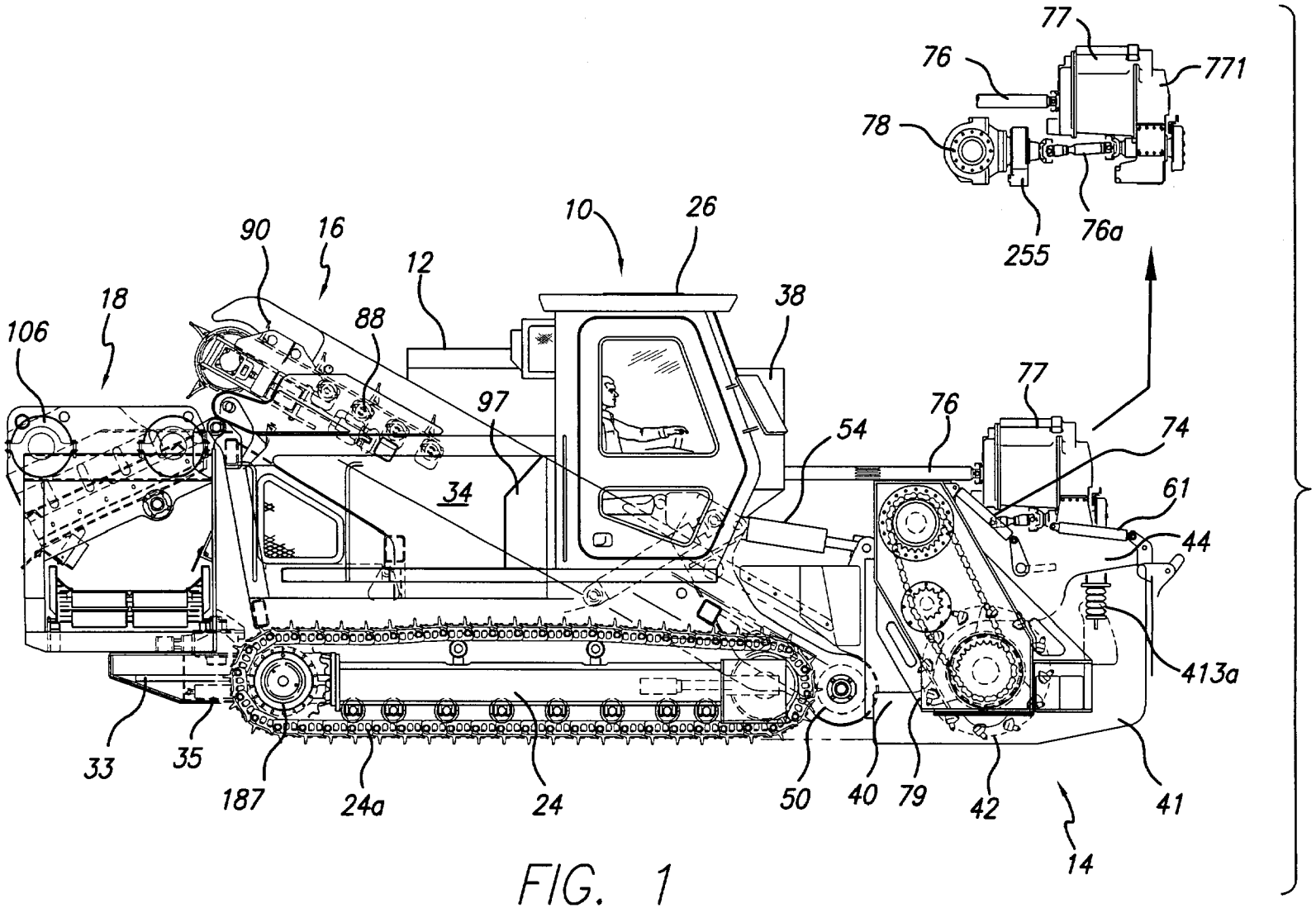
FIG. 1 is a side view of the overall padding machine.

As best seen in FIG. 1, the padding machine hereinafter described has the following major components: the vehicle 10, the engine 12, the front digging auger and frame assembly 14, the up conveyor assembly 16, the screening assembly 18, and the cross-pass conveyor assembly 20.

Figure 4:
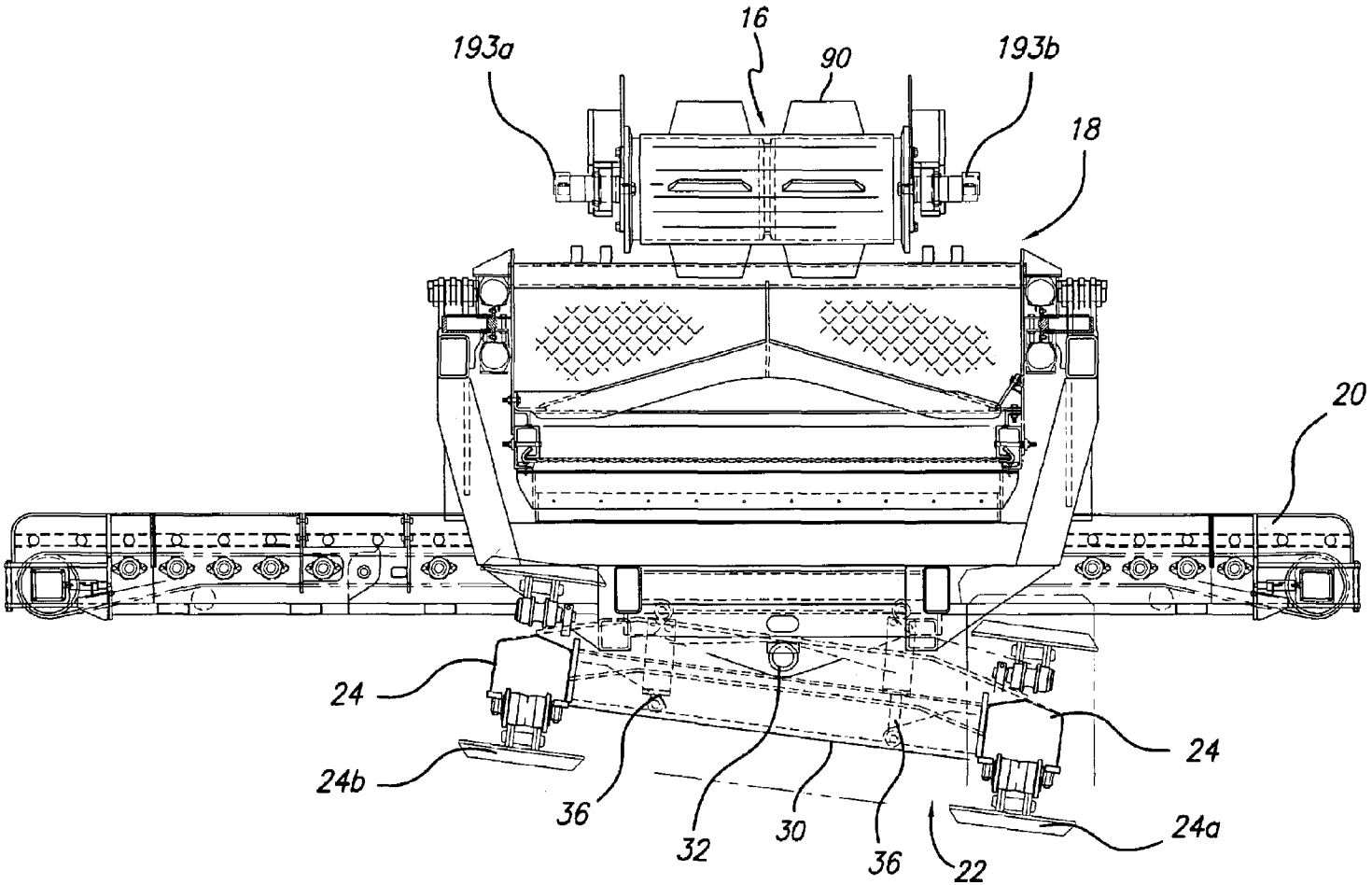
FIG. 4 is a full rear view of the overall padding machine showing how the machine can accommodate side-hill conditions while maintaining the critical components level.
Figure 17:
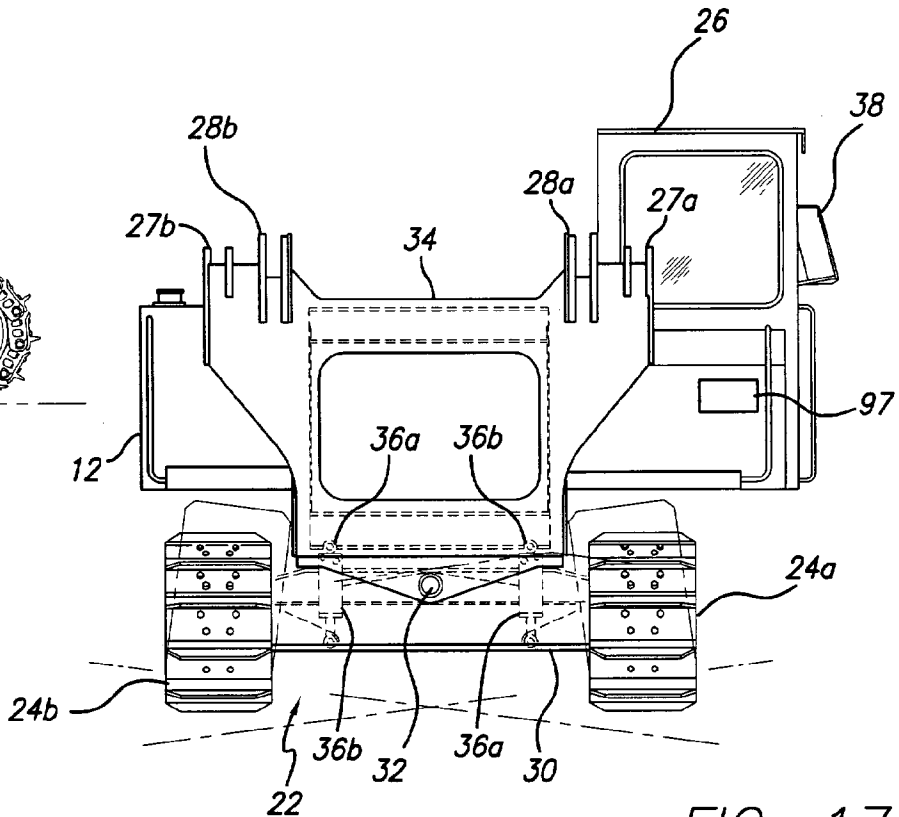
FIGS. 16 and 17 are side and rear views, respectively, of the basic main structure of the machine, showing the overall frame, the upper box frame, the tracks, and the operator's cab.

The vehicle 10 comprises a main frame 22, a track assembly 24 having tracks 24*a* and 24*b*, and an operator's cab 26. As best seen in FIGS. 4 and 17, the main frame 22 comprises track cross members 30 having a central pivot point 32 and a box frame 34 that is pivotally attached to the cross members 30 at pivot point 32, and which will provide the main support structure for the other components (such as the up conveyor and screening assemblies). A pair of front and back hydraulic arms 36*a* and *b* are attached between the box frame 34 and the cross members 30 and act to maintain the box frame 34 (and hence the component parts attached thereto) level as the vehicle traverses slopes and as the tracks independently move over bumps and other obstacles. In FIG. 4, the vehicle is shown traversing a side-hill slope yet all parts of the padding machine above the tracks remain level.

Figure 7:
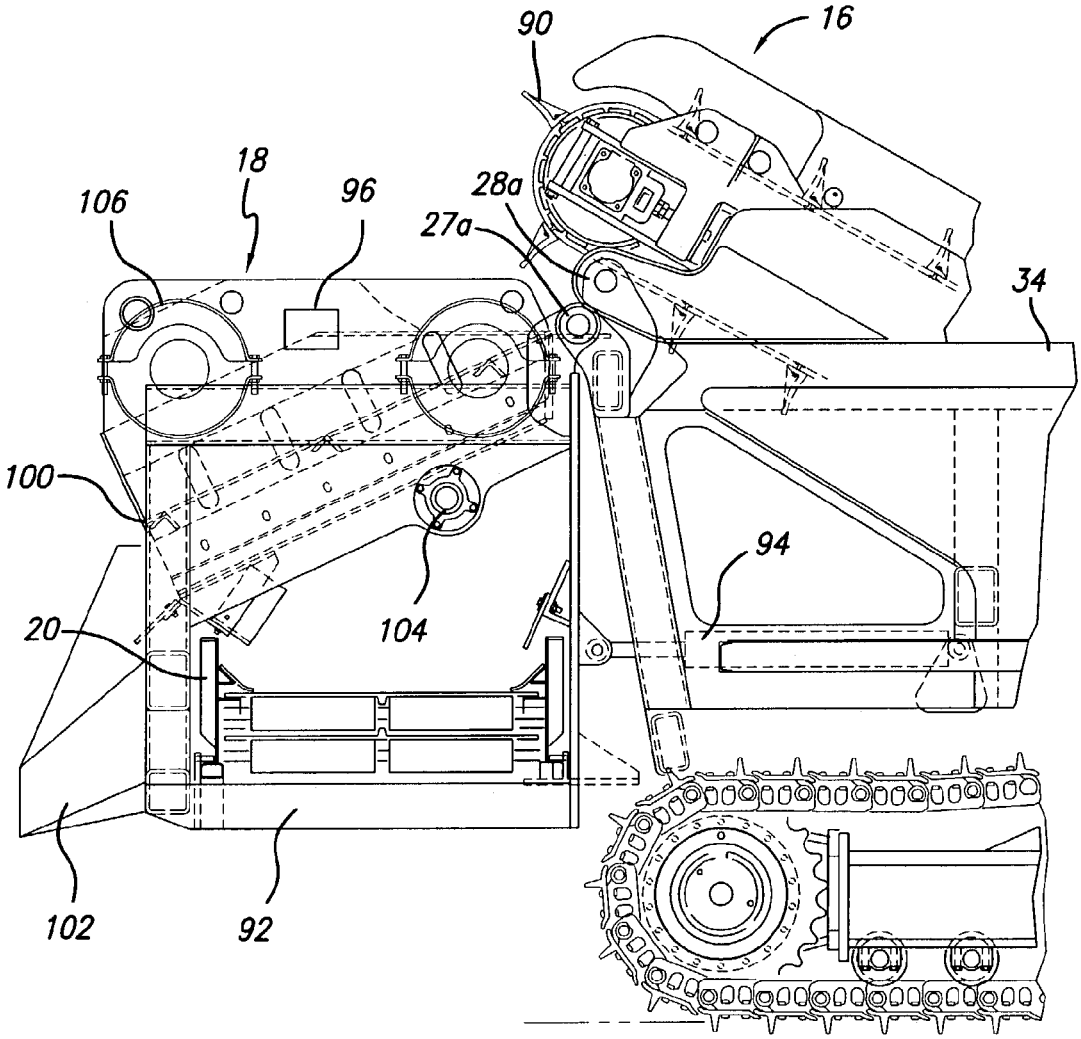
FIG. 7 is a side view of the rotatable screening assembly and cross-pass conveyor that allows the machine to operate on up slopes and still have the screen and cross-pass conveyor at their preferred orientation, also showing the preferred location of the level controller and the hydraulic cylinder by which the position of the screening assembly and cross-pass conveyor is adjusted in response to signals from the level controller. It also shows the eccentric, variable speed, hydraulically-powered vibrator that provides the shaking movement to the screen assembly, as well as the mounting tires attached to the screen assembly that can vary the stroke of the vibrating screen.
Figure 16:
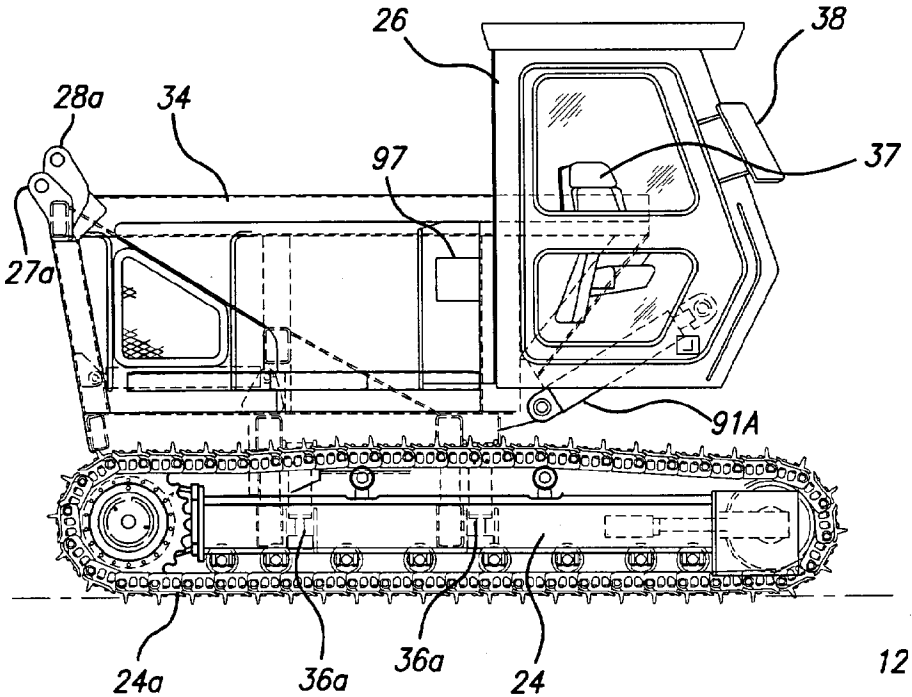

As best seen in FIGS. 7, 16 and 17, the box frame 34 has a pair of pin/pivot brackets 27*a* and *b* that are used to attach the screening assembly 18 and the cross pass conveyor assembly to the box frame 34, and pin/pivot brackets 28*a* and *b* that are used to attach the upper end of the up conveyor assembly 16 to the box frame 34.

Figure 23:
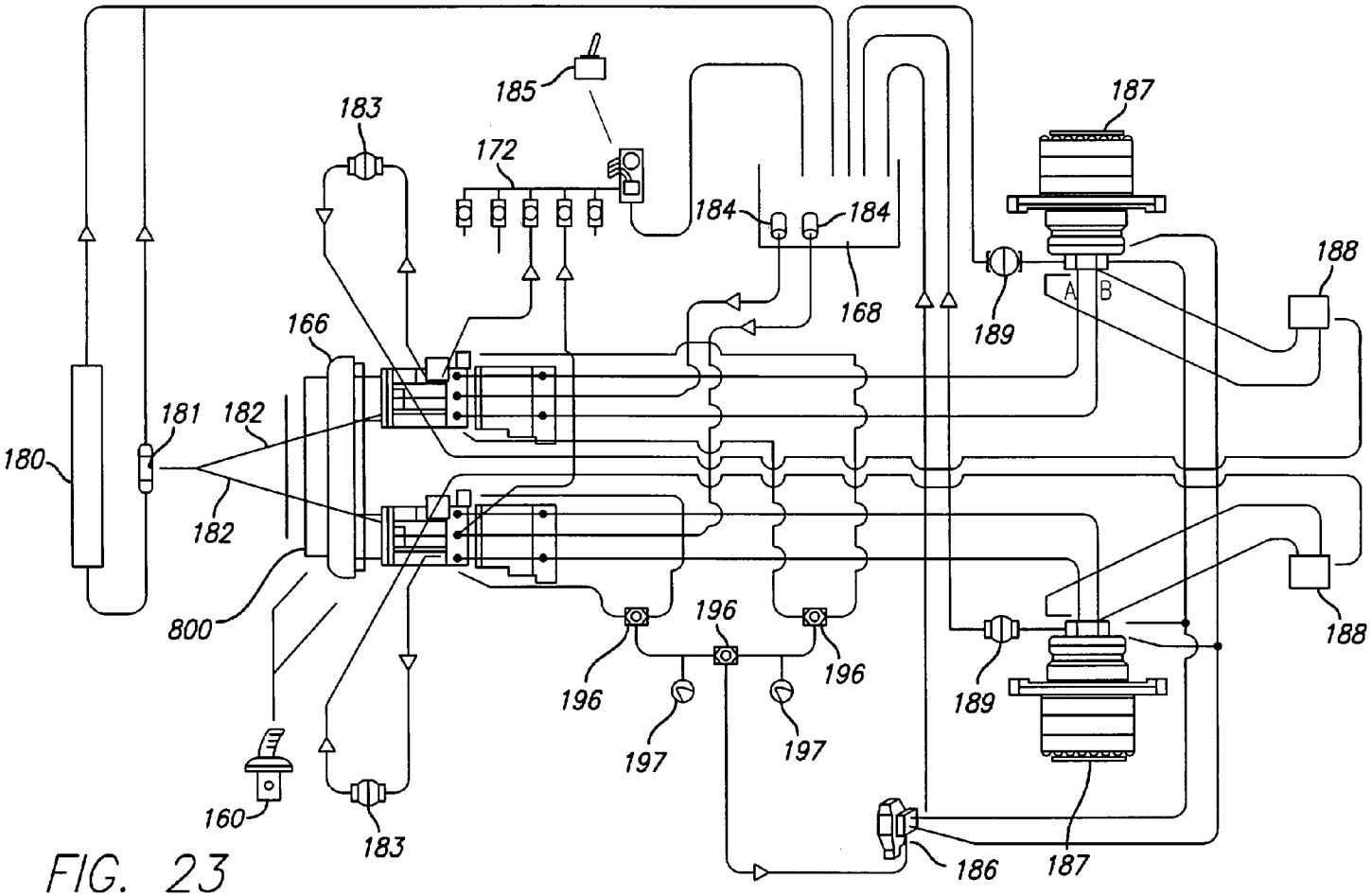
FIG. 23 is a schematic for the hydraulic circuit that controls the track drive.

The track assembly 24 utilized is preferably the conventional track assembly from a Caterpillar or similar tracked vehicle (such as that utilized on the Cat 330 Excavator). It will be fitted with a conventional hydraulic leveling device 97 that operates to extend or retract cylinders 36 and hence leveling the machine side to side, and each track will be separately powered by a conventional hydraulic motor and transmission system (shown schematically in FIG. 23) that will allow the tracks to move independently in the forward or reverse direction. The hydraulic power will be provided in the conventional way by engine 12. The preferred hydraulic system for the tracks is shown in FIG. 23.

The operator's cab 26 is attached to the outside of the box frame 34 on the side of the vehicle that will be adjacent the trench during operation so as to provide relatively unobstructed view of the trench and the front digging auger and frame assembly 14. The cab 26 is fully enclosed with windows on all sides, and is pressurized with filtered air and is air conditioned. It has a swiveling chair 37, and is equipped with one or more strategically placed mirrors 38 to provide the operator with instantaneous sight to several of the machine's major components.

Figure 18:
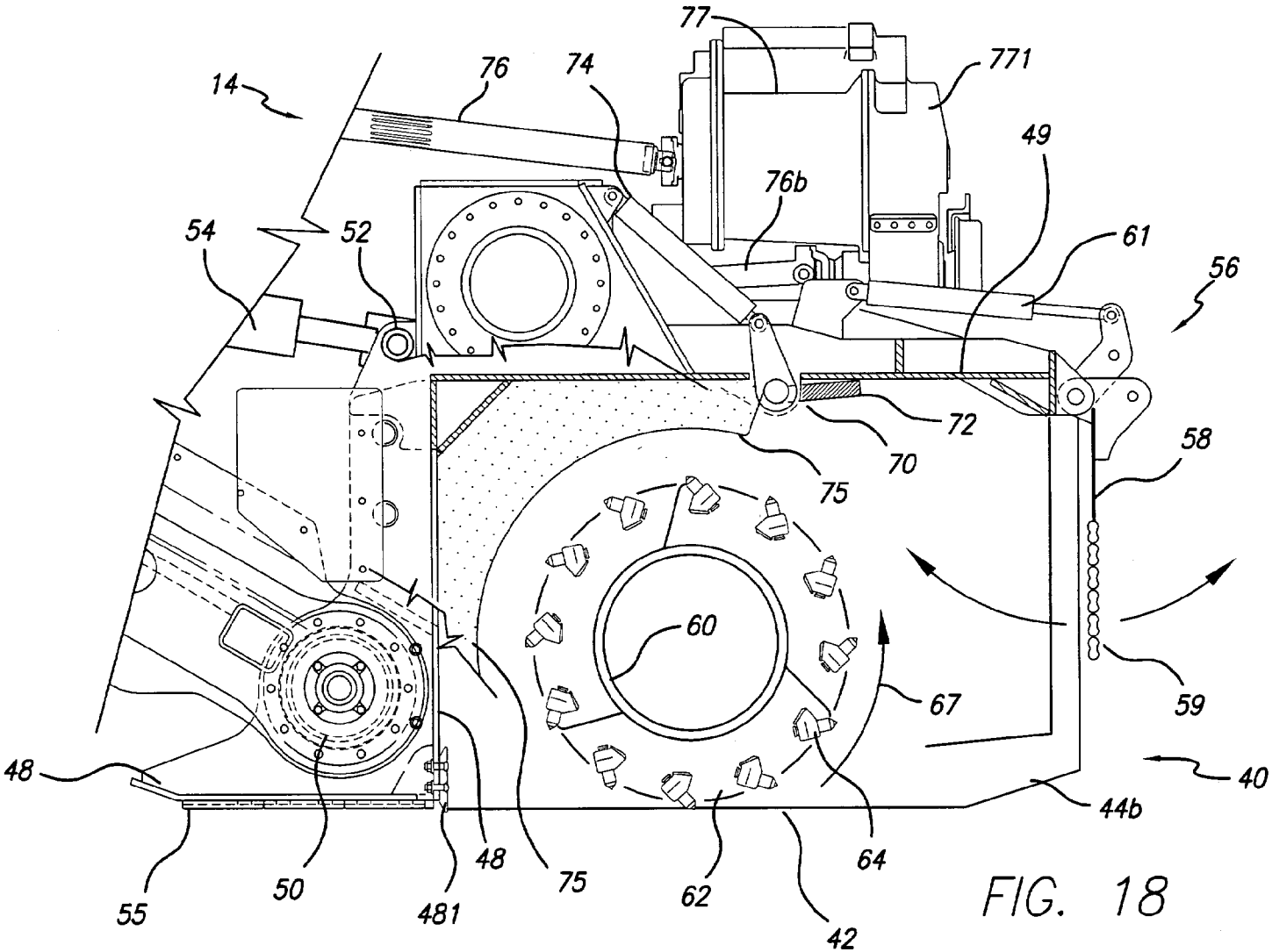
FIG. 18 is a section side view of one embodiment of the digging auger and box assembly, showing the preferred placement of the breaker bar assembly, showing the pivot point and hydraulic piston that allows for adjustment of the breaker bar relative to the position of the digging auger, and the front guard plates and chains that prevent material dislodged by the digging auger from being thrown forward and outside of the box assembly.
Figure 19:
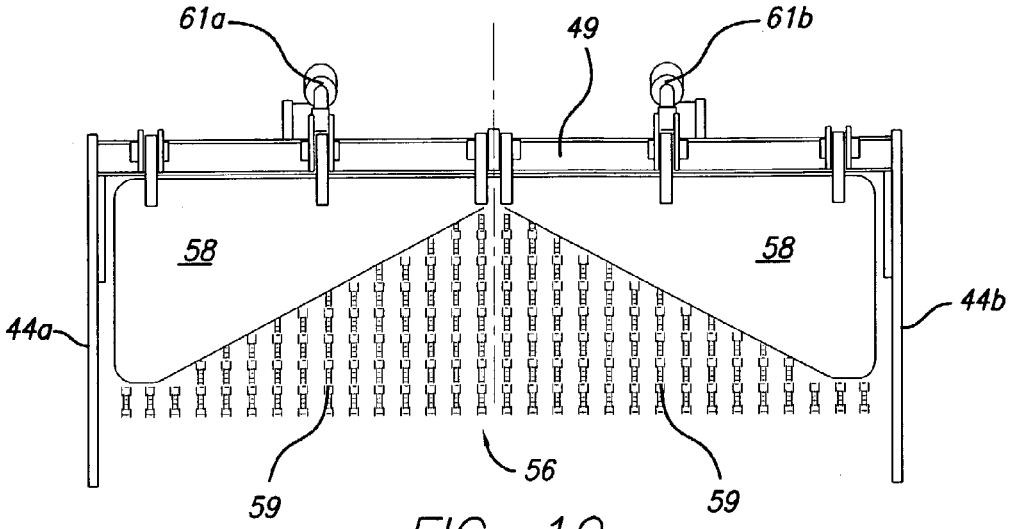
FIG. 19 is a front view of the preferred embodiment of the guard plate assembly, showing the upper plates and the chain links that hang from them.
Figure 20:
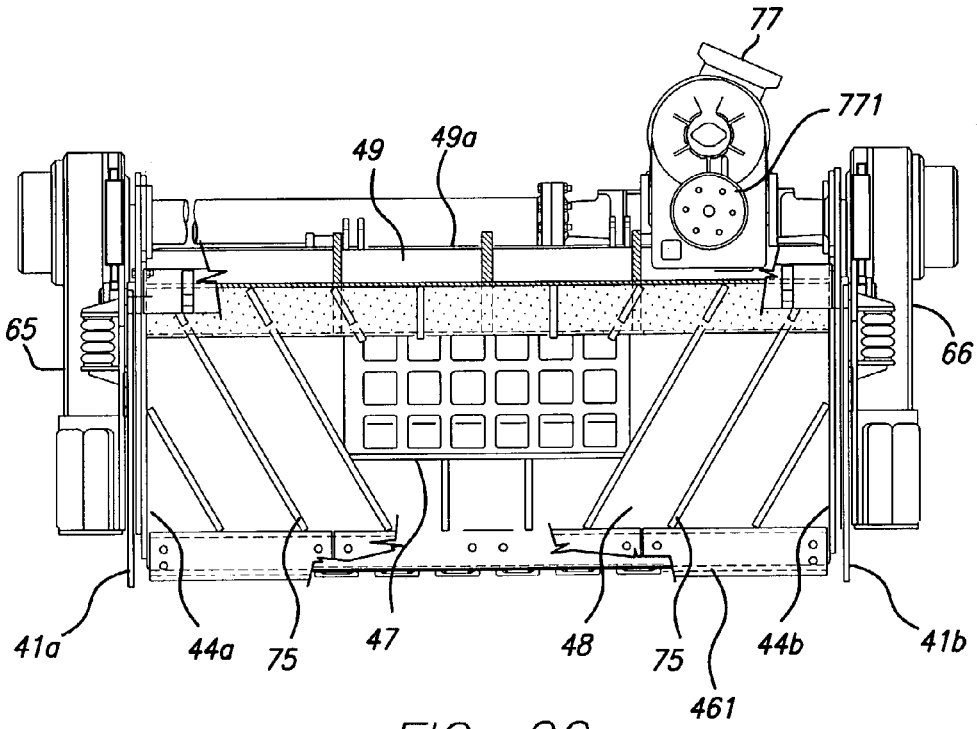
FIG. 20 is a front view of the auger assembly, with the digging auger removed, showing the placement of the sizing window in the back of the auger box that will act to prevent too large objects from being delivered to the up-conveyor.

As best seen in FIGS. 18, 19 and 20, the front auger and frame assembly 14 comprises an auger frame 40 to which the digging auger 42 is rotatably attached in the conventional way by means of a bearing housing 50. The auger frame is a conventional frame comprising two side plates 44*a* and 44*b*, a rear plate 48, top plate 49*a*, and cross member 49. A bottom cutting edge 481 is attached to the bottom of the rear plate 48. The auger frame 40 is constructed of sufficiently thick plate steel (1 to 2 inches thick) to withstand the stresses created by the rotating auger 42 and the forward movement of the machine. It is important that the side plates 44*a* and 44*b* not have any bottom horizontal flanges or plates that would prevent or hinder the digging auger 42 from being able to dig into the virgin soil under the spoil bank.

Figures 20A, 20B:
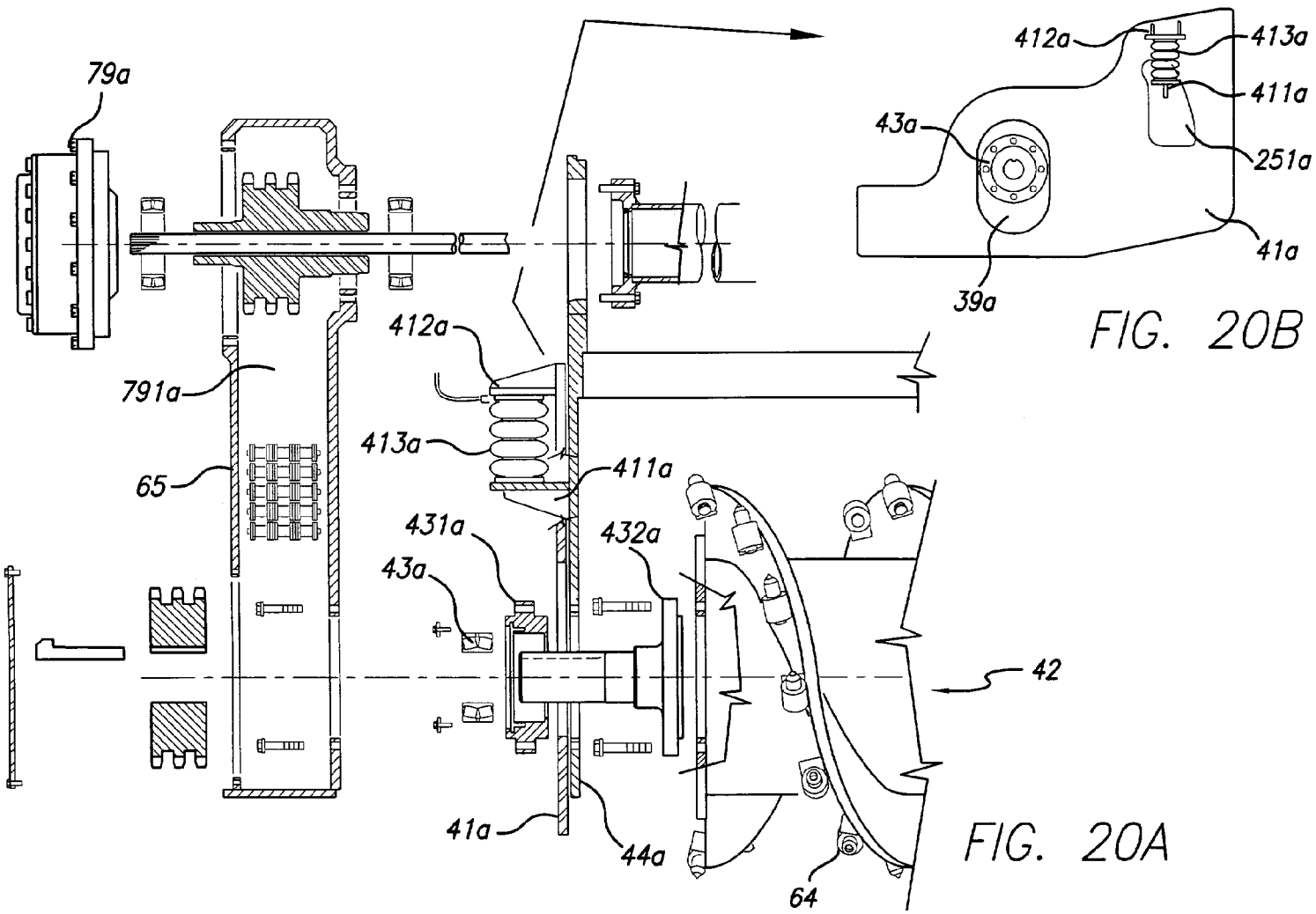
FIG. 20A is a partial exploded view of one end of the auger assembly showing its principal attachment components.
FIG. 20B is an isolation, side view of the side plate of the auger assembly showing the attachment bellows and oversized apertures that allows the side plate to move relative to the digging auger.

Attached to either side of the frame 40 are floating side plates 41*a* and *b*. The purpose of the floating side plates 41*a* and *b* is to ride along the top of the soil during padding to keep dirt from being thrown outside the auger box even if the auger assembly 40, and hence frame side plates 44*a* and 44*b* are in a slightly elevated position relative to the ground. As best seen in FIG. 20B, the floating side plates 41*a* have a slight streamlined front edge to assist it in "riding over" the ground. The plates 41*a* and *b* are attached to the side plates 44*a* and 44*b* respectively of the box 40 by means of lower bracket 411 that is attached to the outside of side plate 44, and an upper bracket 412 that is part of the floating plates 41*a*. Airbags 413*a* and 413*b*, which can be selectively inflated and deflated by the operator, are disposed between the two brackets 411 and 412. Inflating the airbag 413 moves the floating plates 41*a* and *b* upward relative to the box 40 (as may be desirable from time to time) and deflating the airbag 413 allows the plates 41*a* and 46 to freely "float" on top of the ground.

As best seen in FIG. 18, the auger and frame assembly 14 is rotatably attached at a bottom pivot point 50 to the up conveyor 16 frame, and is adjustably attached at an upper pivot point 52 to the up conveyor 16 frame by means of a hydraulic piston 54. As the piston 54 is extended or retracted, the auger and frame assembly 14 rotates forward or aft. The auger and frame assembly 14 will also be outfitted with a guard plate assembly 56 that will act to prevent material being thrown forward by the digging auger 42. As best seen in FIG. 19, the guard plate assembly 56 comprises two plates 58 that form a "V" shape and lengths of chain 59 that hang below them to intercept any rocks or projectiles thrown forward by the digging auger 42. Two hydraulic cylinders 61*a* and *b* are used to raise and lower the guard plate assembly.

Figure 2:
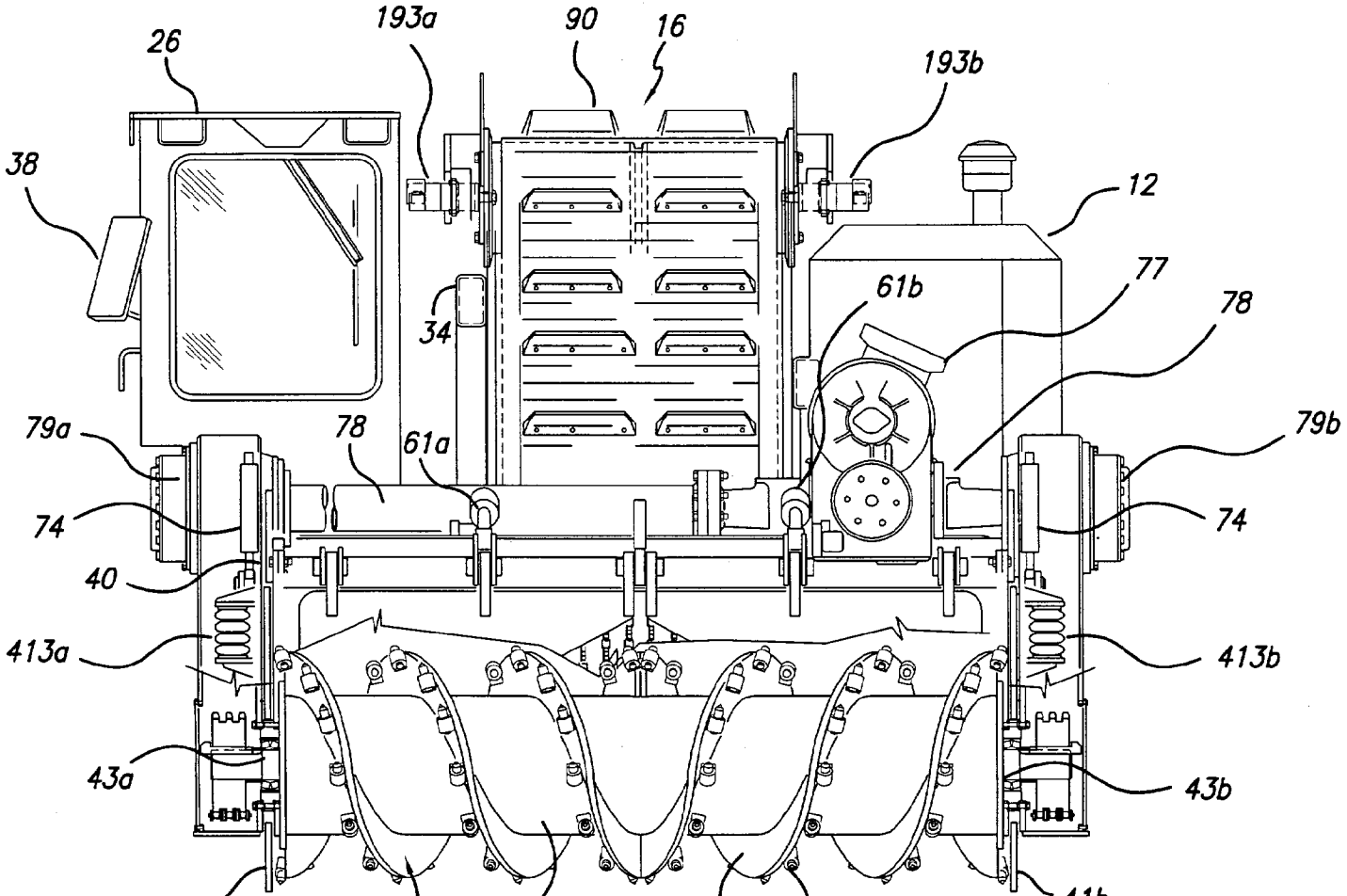
FIG. 2 is a partial front view of the overall padding machine.

The preferred digging auger 42 can be adapted from any of the commercially available digging augers now available and currently used for removing asphalt from roads, such as the Cat 565B Cold Planer or the Cat PR1000 Cold Planer. The digging auger has a central drum 60 having extending flights 62 which are situated so as to move the spoil material toward the center of the auger 42, as best seen in FIG. 2 where it is seen that the flights 62 are generally angled from the outside in, forming a centrally-located "V" in which the open end of the "V" faces rearwardly toward the up conveyor 16.

Carbide teeth 64 are attached around the periphery of the digging auger 42, either to the outside edge of the flights 62 or to the drum 60 or both. The teeth 64 are angled in the rotational direction of the auger 42 and actually dig into the spoil pile and/or the underlying virgin soil. The rotation of the auger 42 is forward, up and back, meaning that when viewed from the front of the machine, the bottom of the auger 42 is moving in the forward direction and the top of the auger is moving in a rearward direction. (See direction arrow 67 in FIG. 18.) The action of the flights 62 and to a lesser extent the teeth 64 force the dislodged spoil onto the up conveyor 16.

The preferred digging auger 42 is large, being approximately 41 inches in diameter and 10 feet wide or wider, and is designed and constructed to rotate at variable speeds, including peripheral speeds up to 1700 feet per minute.

As will be appreciated, this digging auger 42 will perform the following four tasks: 1) it will bring spoil material to the up conveyor 16; 2) it will break apart any frozen crust on the spoil pile; 3) by virtue of the carbide teeth rotating at such a high rate of speed, it will immediately start to break apart dirt clods and other aggregate material; and 4) in conjunction with the breaker bar discussed below, it will provide a grinding and crushing capability that will further reduce the size of rocks and aggregate material in the spoil, creating even more fines.

The breaker bar assembly 70 is best seen in FIG. 18, wherein the breaker bar 72, which is an elongate piece of steel that extends across the entire length of the auger 42, it is located within a predetermined or adjustable distance above auger 42. It can be made adjustable by means of a hydraulic piston 74 that raises or lowers the bar 72 where it rests against gussets 75. As seen in FIG. 20, the gussets 75 are angled to facilitate movement of the spoil to the up conveyor. Once the bar 72 is in place, any dirt clods, or rocks or other aggregate material that are too large to fit through the space between the bar 72 and the auger 42 will be trapped there against the bar 72 by the continuing rotation of the auger, and will continue to be ground down by the carbide teeth 64 on the digging auger 42. The dirt clod or rock will be broken or crushed into smaller component parts (which may be small enough to become fines) or may be ground down in size until it is small enough to pass the breaker bar 72 onto the up conveyor 16. The material ground from the piece may now also be small enough to become fines.

The engine 12 will provide all of the power for the operating components on the machine. The preferred engine is one adapted from the Caterpillar SM-350, and the 300 horsepower version is preferred over the larger horsepower version. Because the auger 42 is directly powered by the engine, as opposed to being hydraulically powered, and because in operation the digging auger is going to encounter large objects such as large rocks, metal pieces that have fallen off of the trenchers, and other debris that cannot be processed by the digging auger 42 and the breaker bar, it is important that the power train in between the engine 12 and the digging auger 42 have the ability to slip if need be, but the slippage must not occur so easily or be so great as to adversely affect the ability of the digging auger to perform its tasks mentioned above. Therefore, the need for appropriate torque utilization is particularly keen in this machine.

Figure 13:
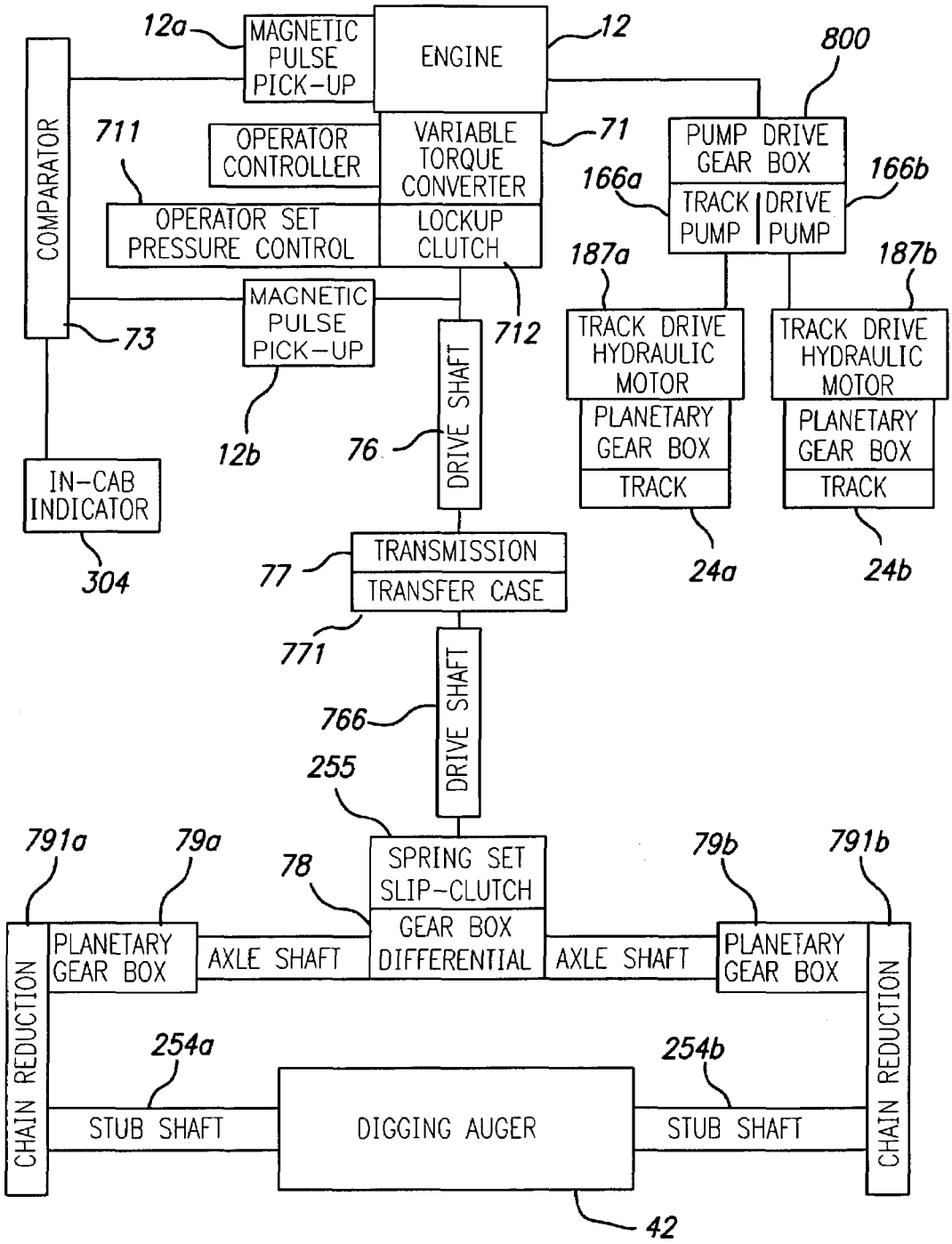
FIG. 13 is a schematic drawing of the drive train from the engine to the digging auger, showing the placement of the drive train, track, auger and drive train sensing components, among other components.

A schematic showing the main drive train components is shown in FIG. 13.

There are three different types of torque converters conventionally used in large excavation and earth moving equipment—a torque converter having a fixed torque curve; one with a variable torque curve and one with a lock-up clutch that prevents any slippage whatsoever.

The torque converter preferred for this machine will allow the output torque to the digging auger 42 to be varied by the operator regardless of the revolutions per minute of the engine at any point in time. Therefore, to provide the most flexibility, a variable torque converter 71 is coupled with a lock-up clutch 712 to allow a very broad range of torque to be transmitted which can be monitored by the operator and adjusted as necessary. The variable torque converter currently used by Caterpillar in its Model 998 Loader is equipped with a lock-up clutch and an operator-controlled variable torque converter assembly that is ideal for this purpose. A standard torque converter could also be used.

It is also desirable to monitor and control the torque converter 71 on an ongoing basis. A pressure control value 711 will be used to control the pressure on the lock-up clutch located in the torque converter. This control valve will vary the pressure on the lock-up clutch piston (pressure plate) (i.e., low pressure=low output torque; high pressure=high output torque), which will cause it to act as a variable slip clutch. In addition, a magnetic pulse pickup 12*a* is mounted to the engine flywheel to measure engine RPMs and another pickup 12*b* measures the RPM's of output speed of the torque converter shaft. The electronic signals from each are sent to a commercially available electronic comparator 73. These signals will be compared for differences (i.e., slippage occurring in the torque converter thus indicating a stall or partial stall of the digging auger) which will be communicated to the operator, who can make the appropriate operating changes, such as less forward machine speed, or more pressure to the lock-up clutch.

This combination will allow the operator to transmit only the needed torque to accomplish the work of processing the spoil while providing protection for the rotating elements of the power train and of the digging auger 42 without the generation of excess heat by the continual slippage of a conventional torque-converter.

This will increase efficiency of the padding process by allowing the operator to optimize the machine's settings and it will also allow the operator to deal more quickly and easily with the occasionally-encountered large rocks or other objects that cannot be processed and become wedged in the auger 42 and bucket assembly 14. For example, when that occurs, the torque to the auger 42 can be promptly reduced to preclude damage by shifting into full torque converter drive and reducing engine speed, but without releasing the rock or object. The auger and frame assembly 14 can be raised, the machine moved in reverse slightly if necessary, and then turned away from the trench, and the auger 42 reversed, releasing the rock in an out-of-the-way area. The machine can then be returned to its former position and the padding operation recommenced.

Figure 3:
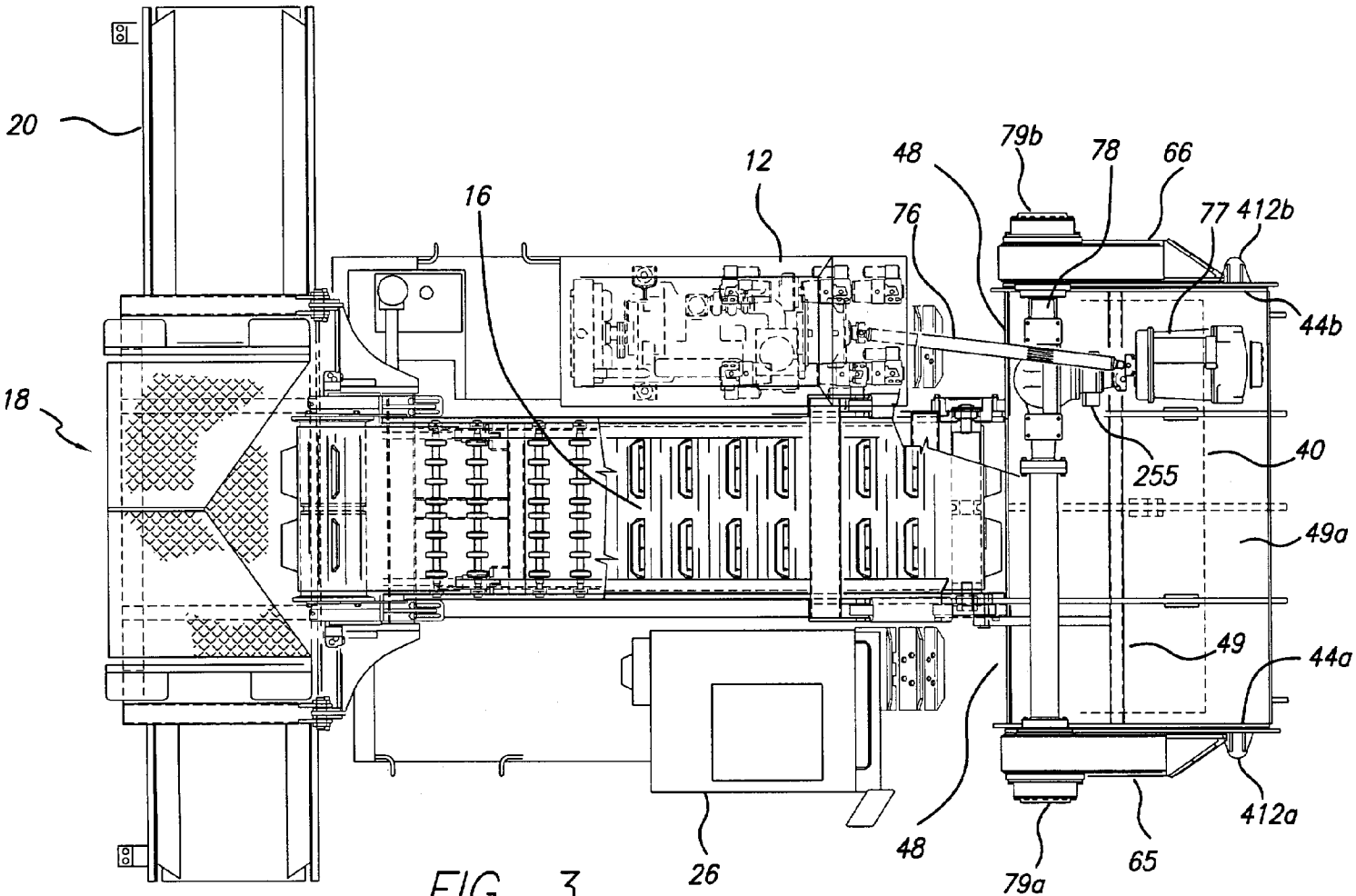
FIG. 3 is a full top view of the overall padding machine.

As best seen in FIGS. 3 and 13, the drive train from the engine 12 to the digging auger 42 will also include a drive shaft 76, a transmission 77, a transfer case 771, a standard axle and gear box differential 78, standard planetary gearboxes 79*a* and *b*, and standard chain-and-sprocket chain reduction assemblies 791*a* and *b* between the end of the output shaft of planetary gearboxes 79 and the auger 42.

Figure 12A:
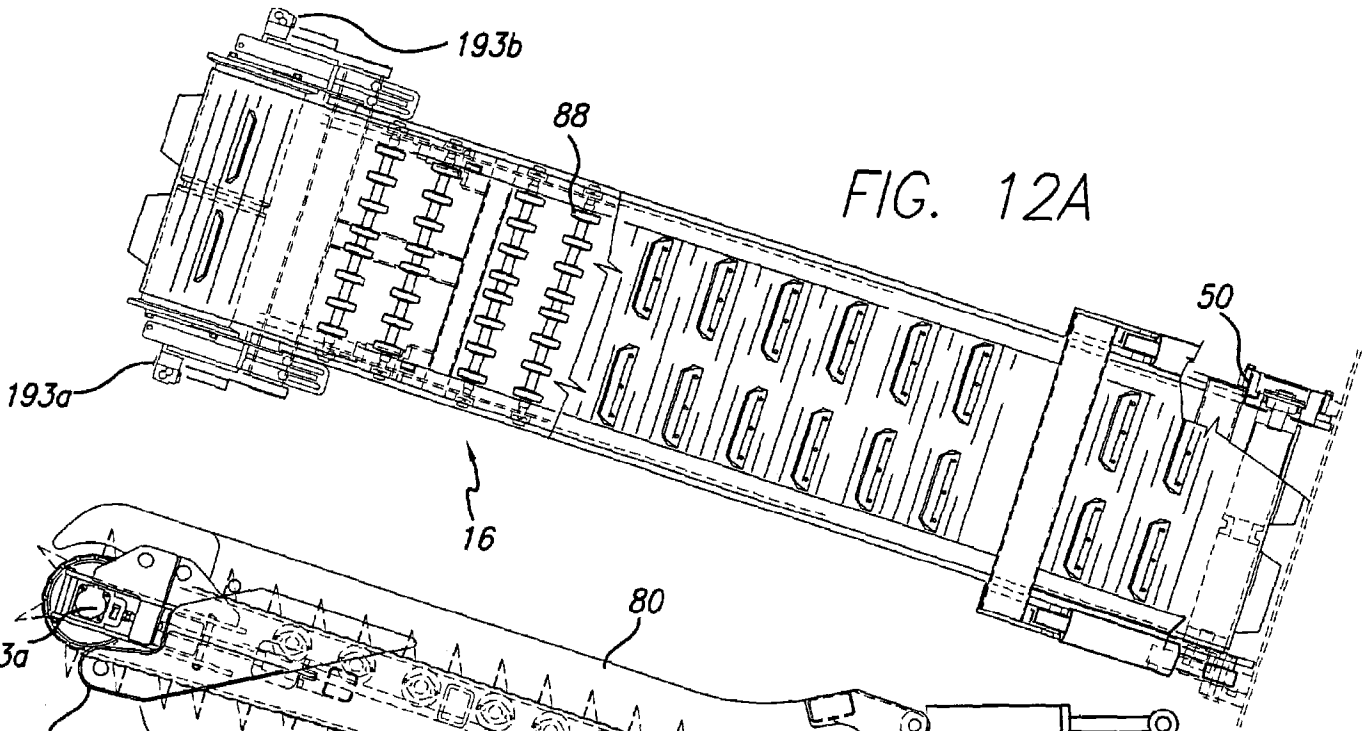
FIGS. 12A to 12H are isolation views of the preferred embodiment of the up conveyor and its components, with 12A being a top view and 12B and 12C being side views showing the conveyor in the "up" and "down" positions respectively.
Figure 12B:
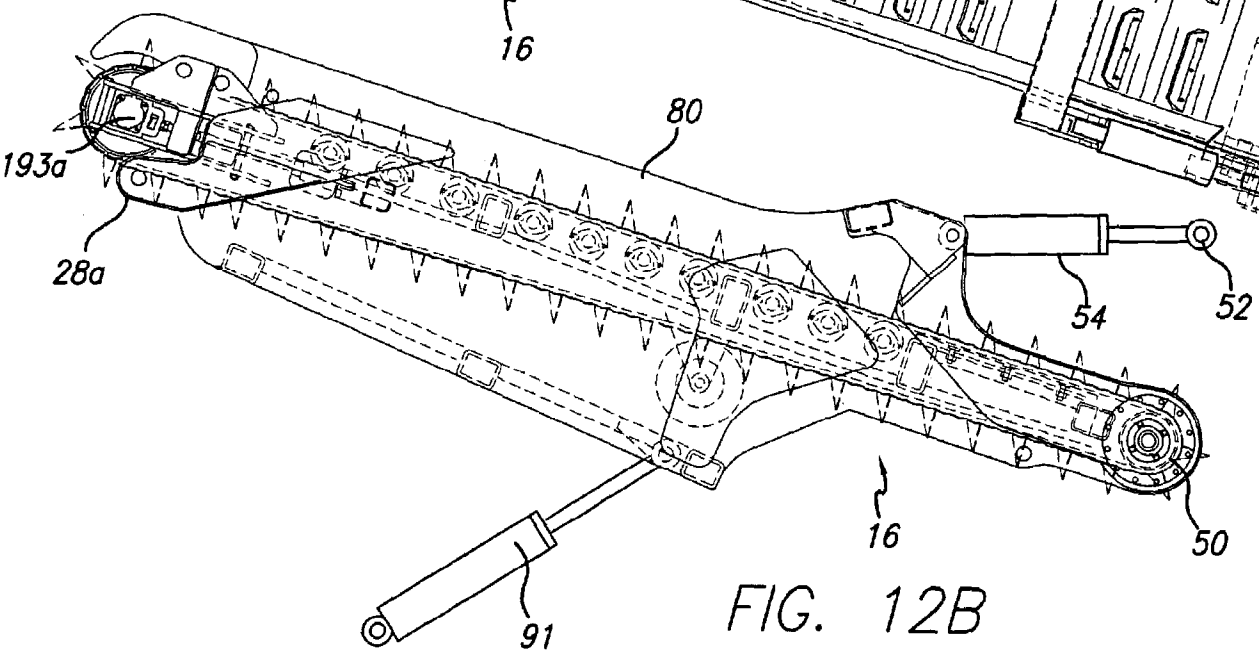
Figures 12C, 12D, 12E, 12F, 12G, 12H:
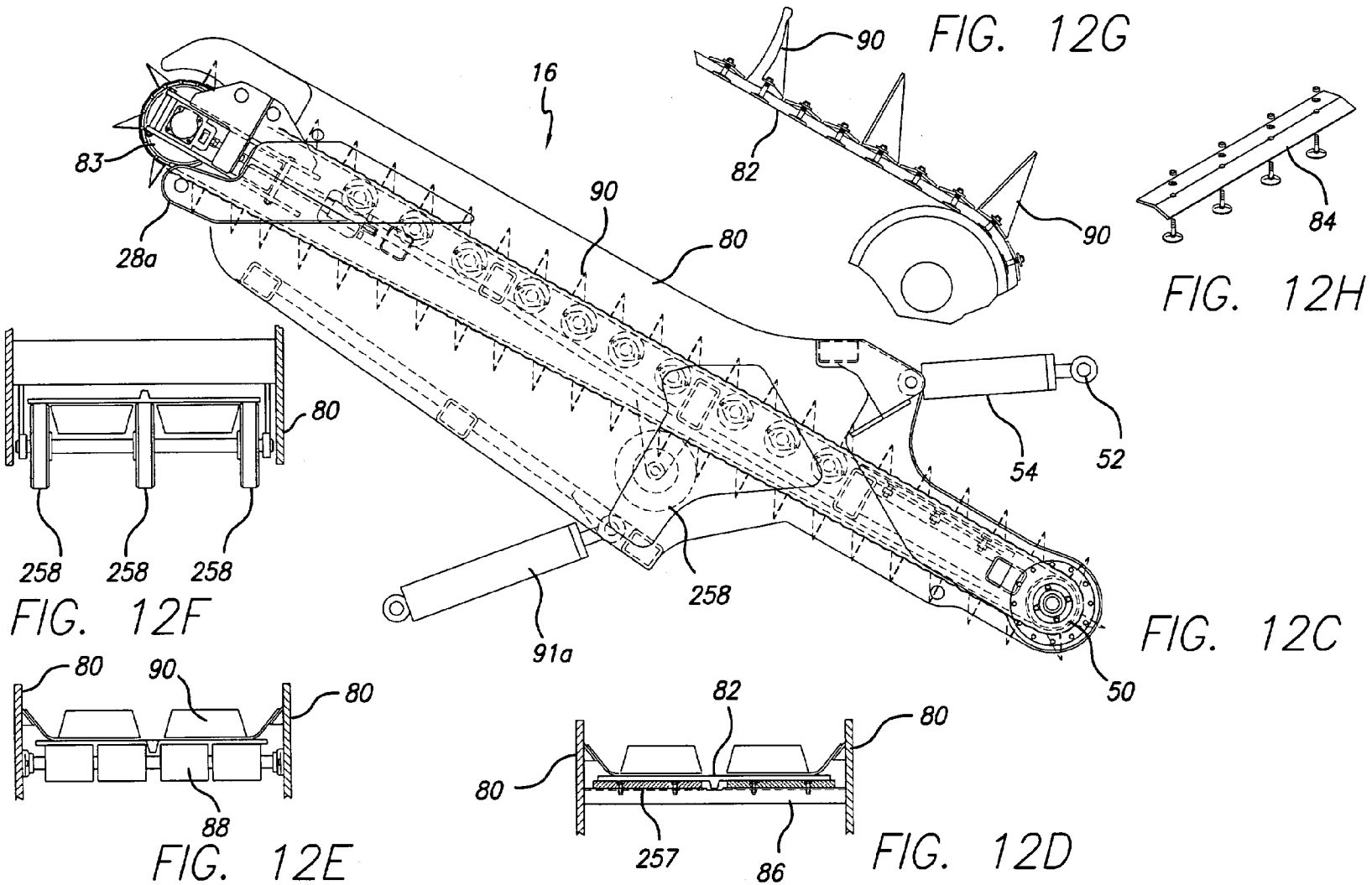

As best seen in FIGS. 12A, B and C, the up conveyor assembly 16 of this machine comprises a frame 80 and conveyor belt 82. The up conveyor 16 has infinitely variable speed and is reversible. It is hydraulically powered, and uses two hydraulic motors 193*a* and *b* to drive a lagged pulley assembly 83 for moving the armored belt 82 endlessly about its track. The belt is a rubber-coated fabric material and is armor-plated, having slightly v-shaped armor plates 84 attached to the rubber coated fabric by conventional nuts and bolts. A metal plate 86 with a plastic overlayment 257 with idler rollers 88 are used to support the underside of the loaded-with-spoil belt 82. Carry-back rollers 258 are positioned under the conveyor belt to support it during its return segment. Steel or rubber paddles 90 are attached to the belt 82 and extend a distance thereabove to aid in carrying the spoil to the shaker screen. The entire up-conveyor assembly can be raised or lowered by means of hydraulic pistons 91*a* and 91*b* that are attached at one end to the underside of the up conveyor frame 80 and at the other end of the main frame 34. When the piston is extended as shown in FIG. 12B, the up-conveyor assembly 16 is raised, and when the piston is retracted as shown in FIG. 12C, the up-conveyor assembly 16 is lowered.

Another improvement incorporated into the preferred embodiment of this invention are means whereby the screening assembly 18 and cross pass conveyor 20 can be rotated relative to the frame 34 so that the screening assembly 18 and cross-pass conveyor 20 can be maintained in the optimal orientation on slopes up to 45°.

Figure 21A:
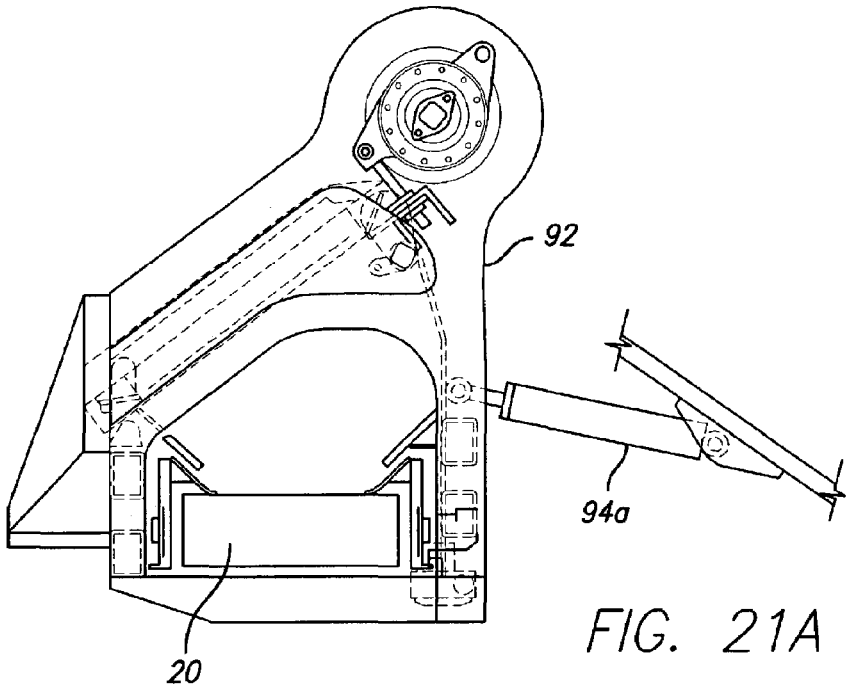
FIGS. 21A and B are isolation views of the screen and cross-pass conveyor assembly showing its orientation when the machine is on level ground and on a 45 degree up-slope, respectively.
Figure 21B:
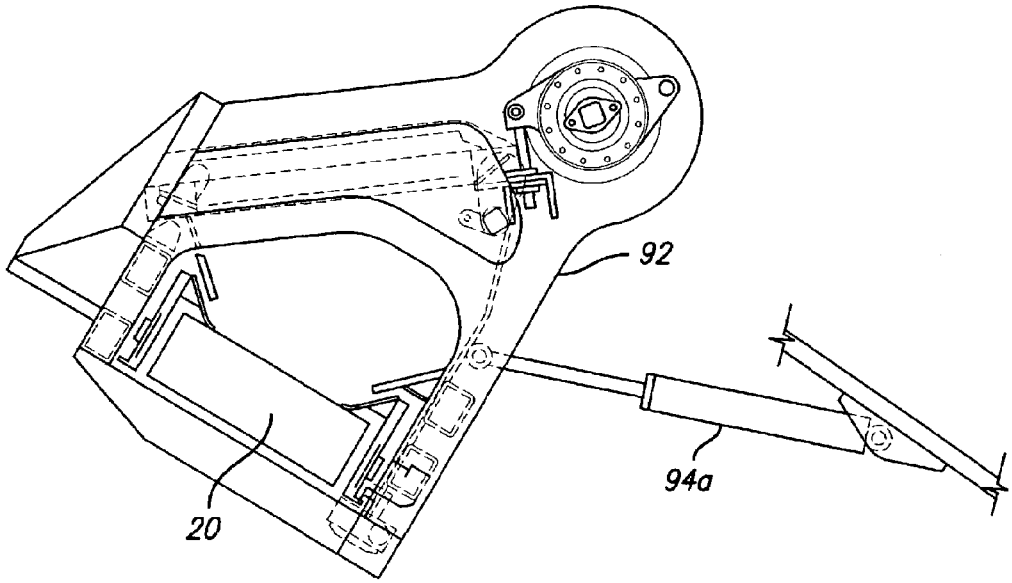

The screen assembly 18 and cross-pass conveyor 20 are housed in a frame 92 that is rotatably attached to the vehicle frame 34. As best seen in FIG. 7, and FIGS. 21A and B, the entire frame 92 can be rotated rearwardly (relative to forward motion of the machine) 45 degrees from the vertical to accommodate uphill padding, and 10 degrees from the vertical in the forward direction to accommodate slight downhill padding. Downhill padding is less desirable since the spoil tends to be pushed downhill and it does not feed into the machine as readily. Therefore, when a steep downhill area is encountered (that is, greater than a 10-degree downhill grade) it is preferred to move the padding machine to the bottom of that grade and then pad the trench back uphill.

Two hydraulically controlled pistons 94*a* and 94*b* are connected at one end to the screen and cross-pass conveyor frame 92 and at the other end to the main frame 34 so that extension and contraction of the piston arms causes the frame 92 to rotate. A conventional level sensing device 96 (for example, Sundstrand Model ACW 112 Level Controller) is attached to the frame 92 and controls the extension and contraction of the piston arms 94 to maintain the frame 92 as close to level as possible, thus maintaining the screen assembly in its optimal angle and the cross-pass conveyor level so that the maximum amount of fines are still being extracted and delivered to the trench.

Figure 10A:
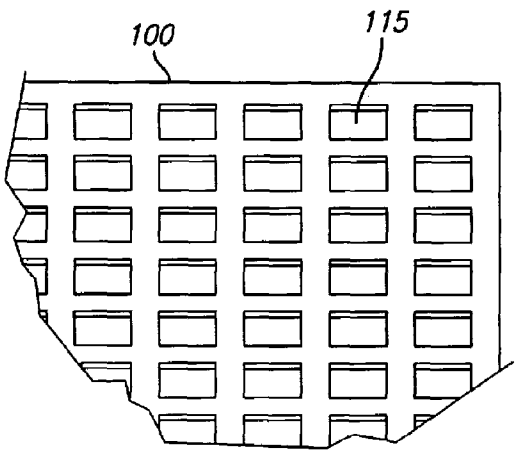
FIGS. 10 and 10*a* show another embodiment of the design of the screen constructed from a metal plate (instead of the usual mesh or woven screen) that is less prone to clogging and is easier to clean.
Figure 10:
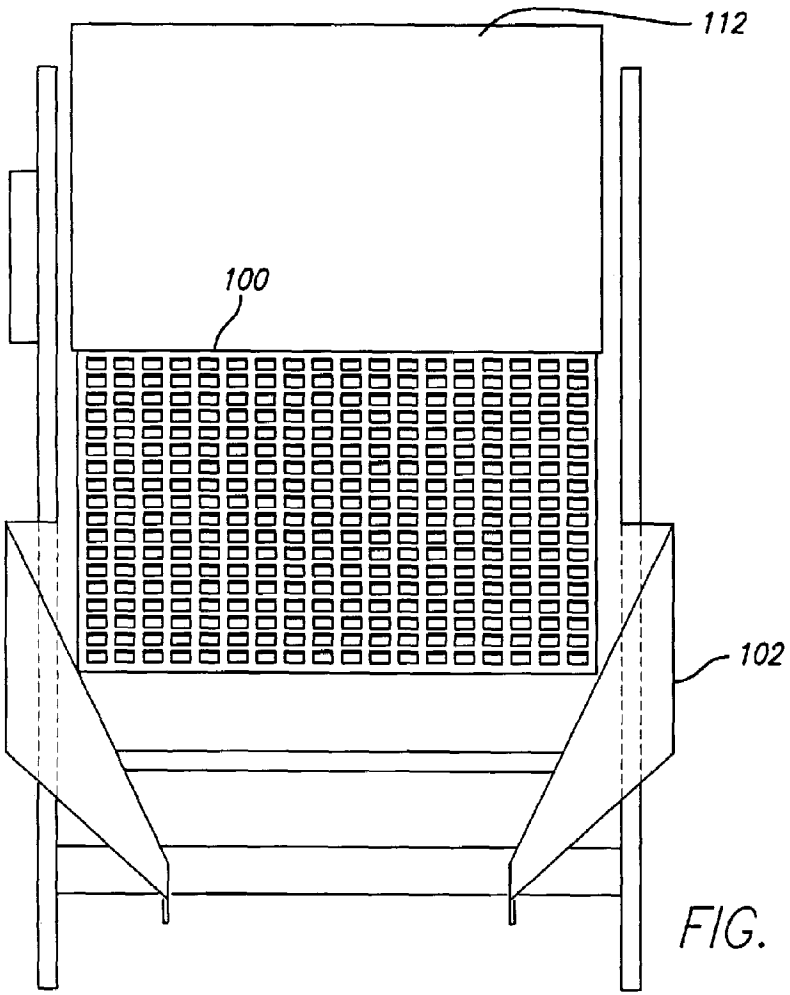

The sizing screen 100 allows the fines to fall through, and causes the coarser material to fall off the back of the machine. As best shown in FIG. 10, the preferred screen 100 is not the commonly utilized woven wire screen in which the warp and weft wires are interlaced in an over-under arrangement, or a harp screen in which a series of parallel wires are drawn tightly across the screen frame. Rather, this screen 100 is constructed of a flat steel plate 112 with the squares or other shaped holes 115 extending therethrough. This will allow for much easier cleaning of the screen. In operation, it is not unusual for the screen to become clogged with grass, roots, mud and other debris. Sometimes, the screen must be cleaned quite often and with the prior art screens, up to an hour could be expended to clean the screens. With this screen, the assistant can use a flat hoe and stiff bristle brush to quickly remove most debris.

Figure 11:
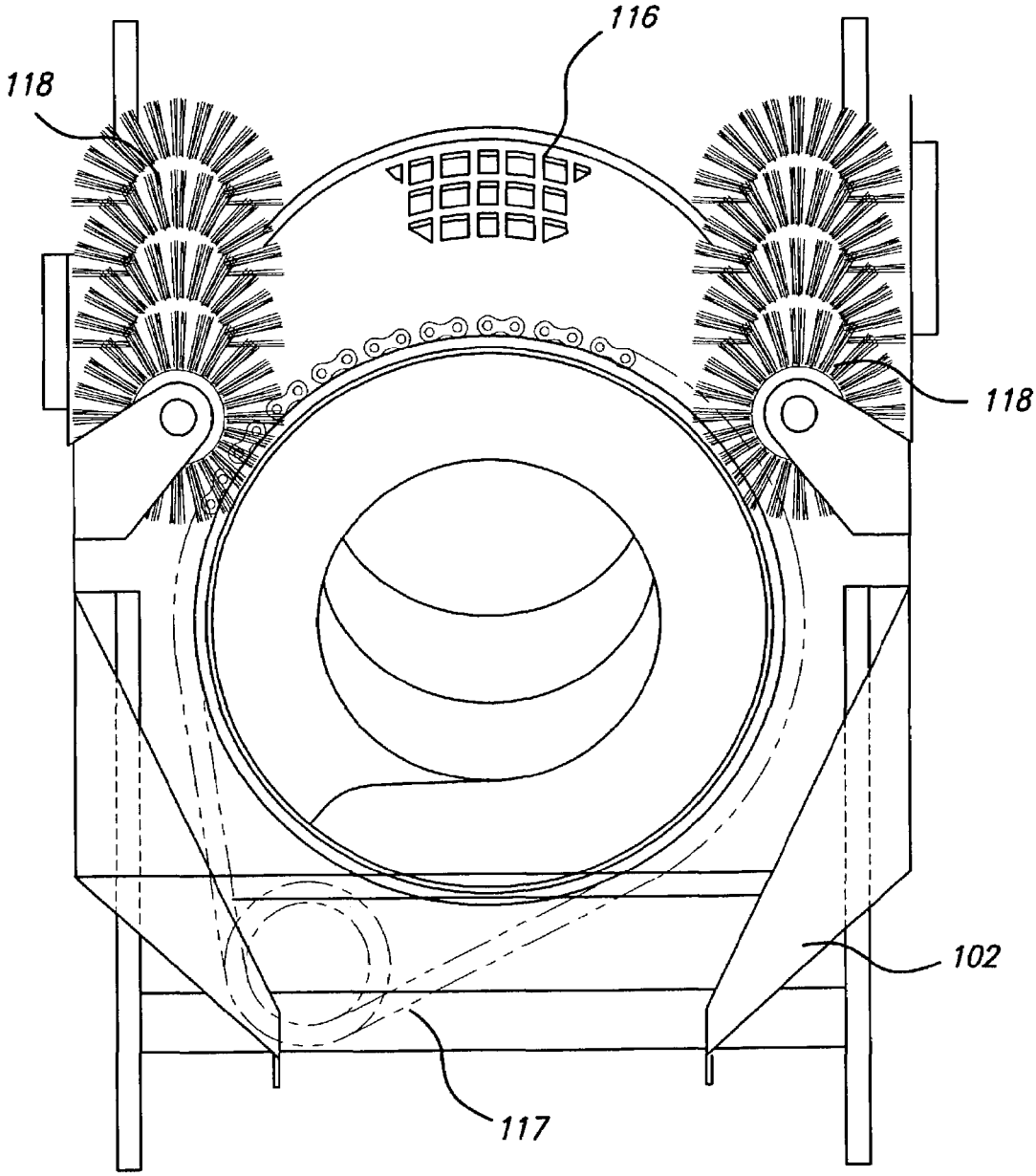
FIG. 11 shows another embodiment of the screen assembly, this being a circular, rotating screen having associated brushes that continually clean the screen of debris. This embodiment is particularly useful in wet and/or grassy conditions where the flat screen would become constantly plugged.

For extremely grassy conditions, a rotatable circular auger screen 116 as shown in FIG. 11 can be utilized. A conventional motor, chain and sprocket system 117 causes the screen to rotate. The spoil will be delivered from the up conveyor 16 to the interior of the rotating auger screen 116. The fines fall through the holes in the outer screen and onto the cross-pass conveyor 20. Bristle brushes 118 can be added to continuously clean the screen.

A gathering chute 102 is used to direct the falling coarse material to a more localized pile behind the machine.

Figure 8:
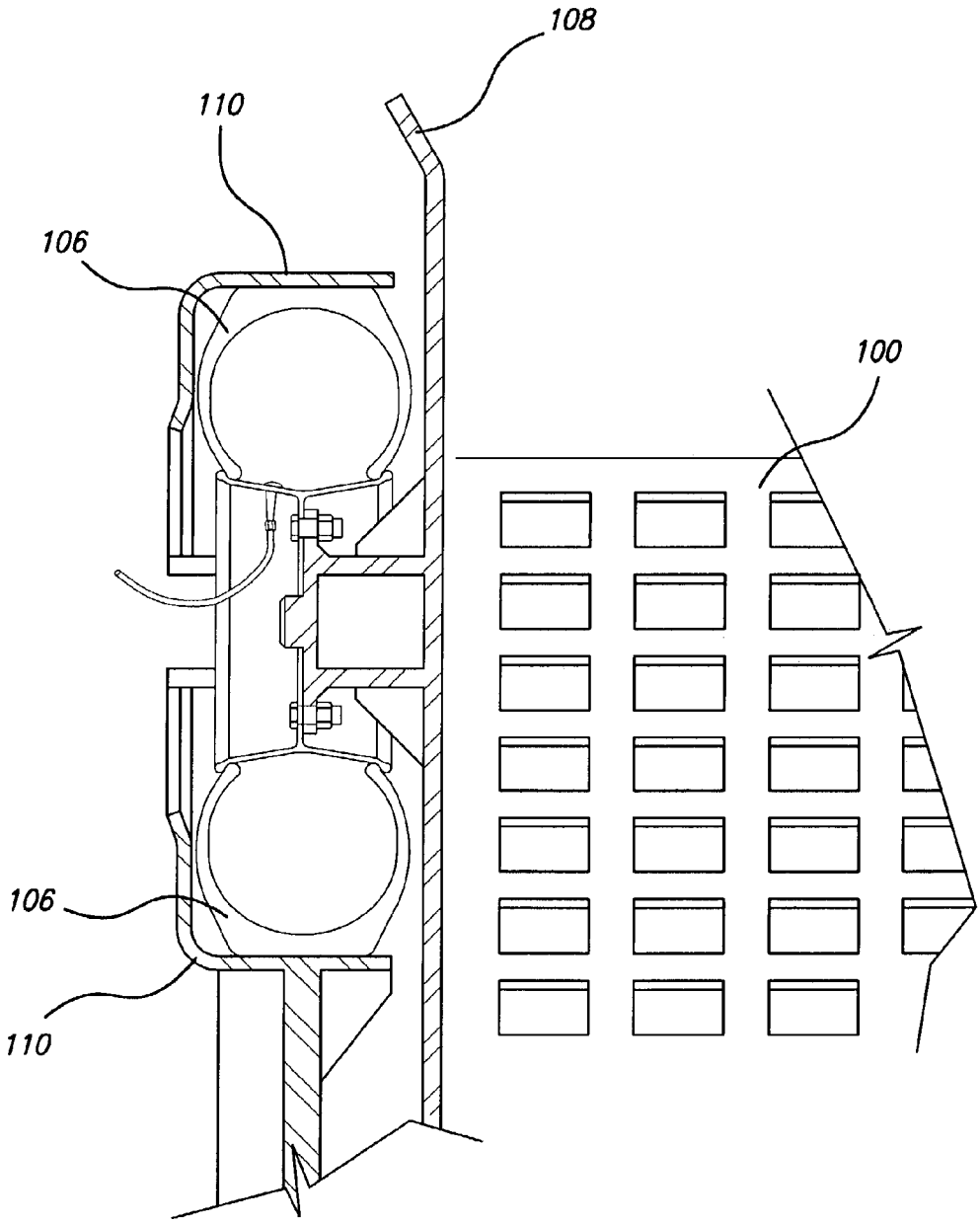
FIG. 8 shows more detail of the mounting tires on the screen assembly and how they ride against brackets attached to the cross-pass conveyor frame.
Figure 9:
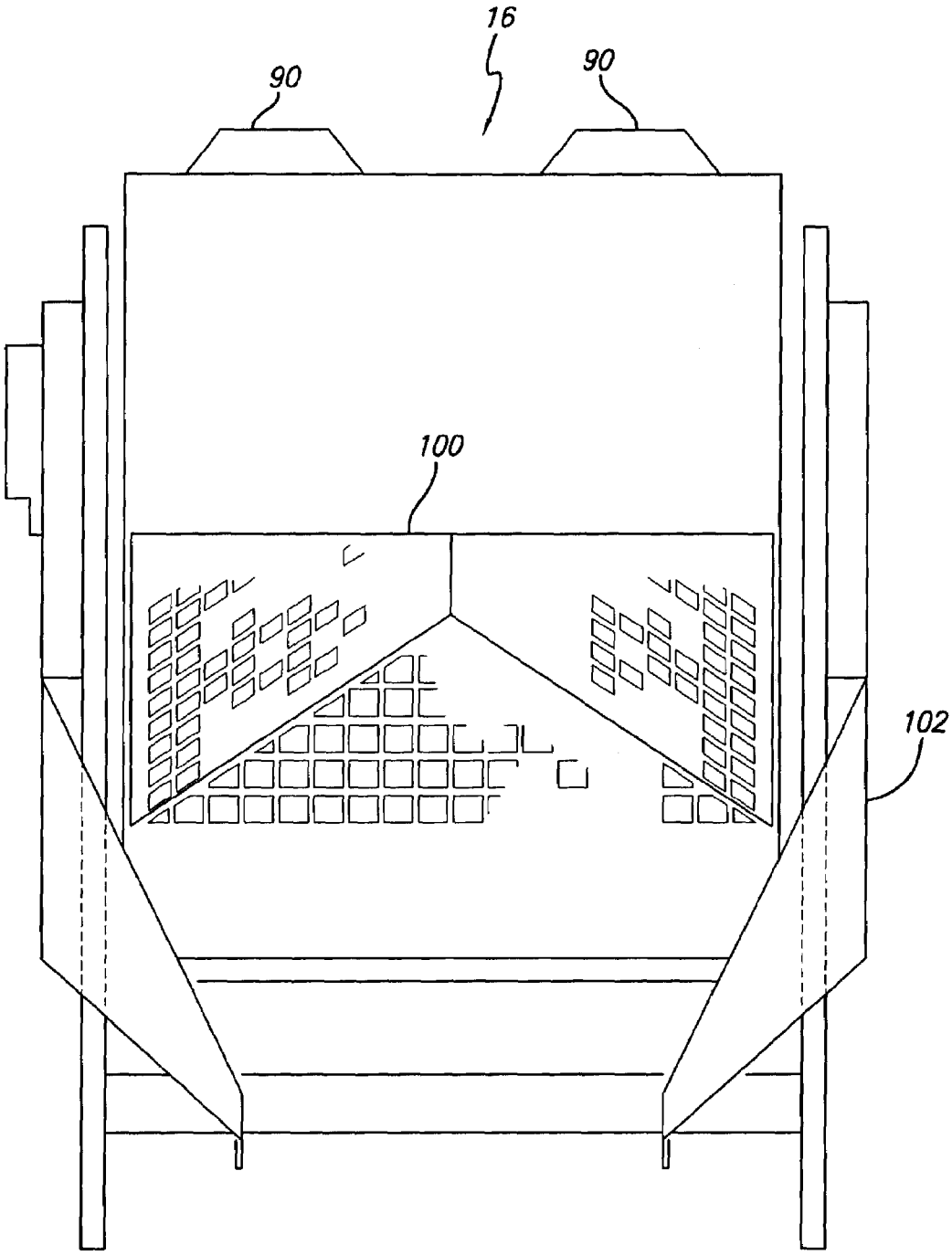
FIG. 9 shows one embodiment of the design of the screen in which it is formed in a partial pyramid shape so as to increase the effective screening area.

The sizing screen 100 is caused to vibrate so as to increase the efficiency of the sizing operation. The degree of vibration of a sizing screen consists of two components, stroke (that is, the distance which the screen moves in either direction, and speed (that is, the speed at which the screen moves through its stroke). The screen 100 in this machine is caused to shake by means of an eccentric, bi-directional, variable speed cam 104. The stroke is controlled, as best seen in FIGS. 7 and 8, by a pair of pneumatic tires 106 attached to either side of the screen frame 108, and which rest against plates 110 attached to the stationary cross-pass conveyor frame 92. The pressure in the pneumatic tires can be varied to control the stroke of the shaking of the sizing screen. As the air pressure in the tires increases, the stroke decreases. This can be controlled by the operator by virtue of an on-board air compressor and a variable pressure regulator in the cab. While the pneumatic tires are the preferred embodiment, conventional steel coil springs, flat steel springs, air bag springs, rubber lattice mounts, or the like, or any combination thereof could be used.

Figure 6:
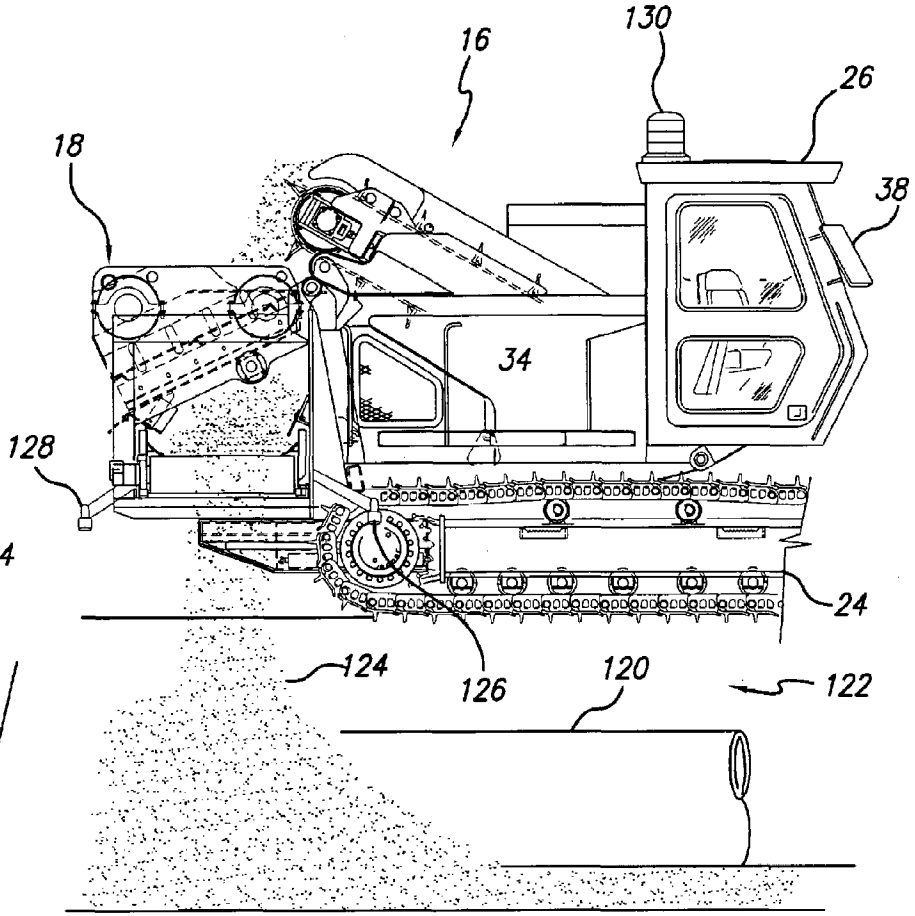
FIG. 6 is a partial side view of the padding machine shown in operation adjacent to the trench, and also showing the location of the padding depth sensors and indicator light.
Figure 15:
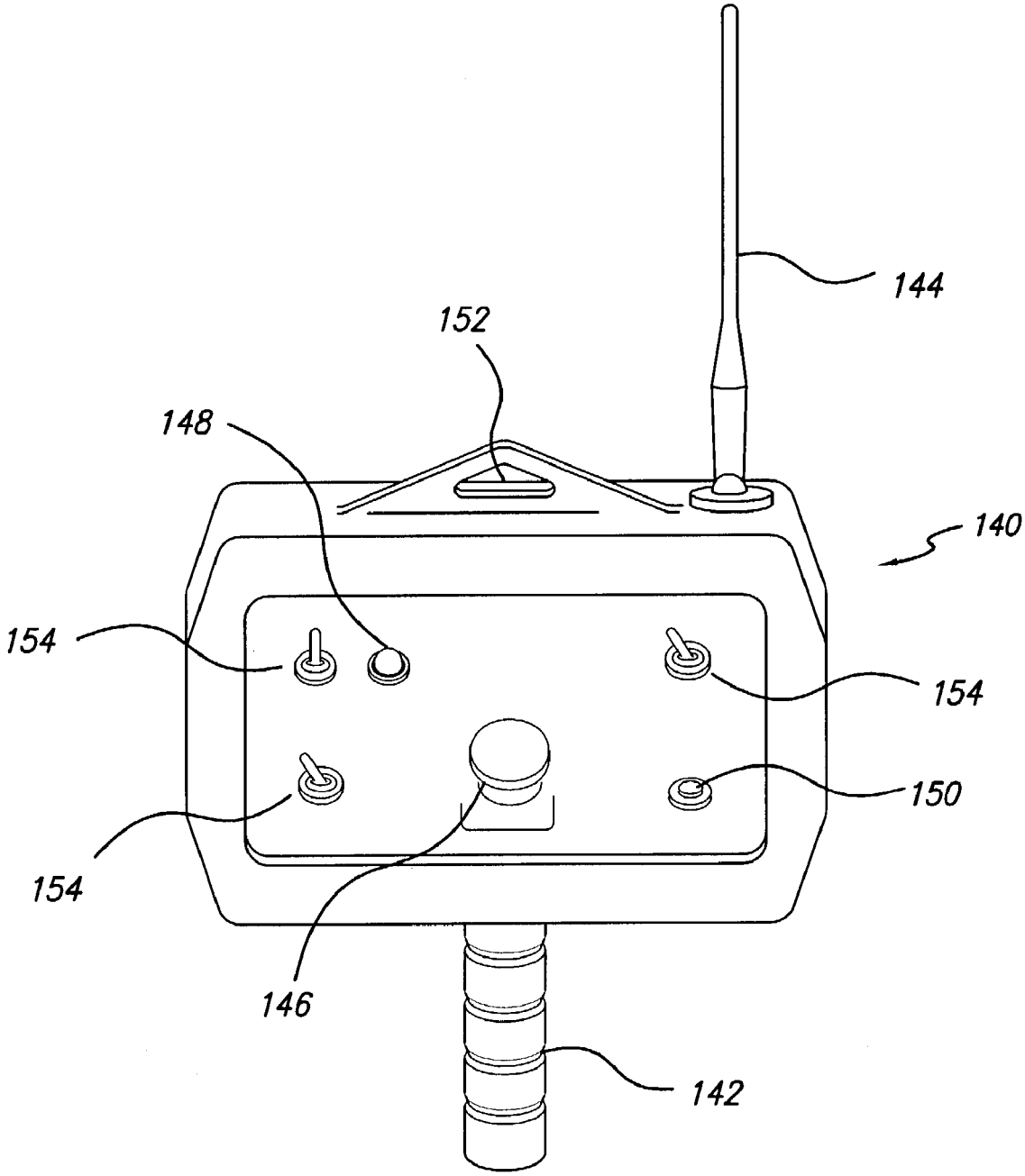
FIG. 15 shows the preferred wireless, hand-held controller for the operator's assistant.

Another improvement in this padding machine is to provide the assistant on the ground with the ability to control certain aspects of the padding operation. As shown in FIG. 15, in the preferred embodiment, a separate, wireless control is provided to allow the assistant to: 1) shift the location of the cross-pass conveyor 20 so that it remains optimally positioned relative to the trench 122 and the pipe 120 as seen in FIG. 6; 2) adjust the speed of the cross-pass conveyor belt 20; 3) honk a horn in the cab to draw the attention of the driver; and 4) to entirely stop all operation of the padding machine (i.e., a "kill" switch for emergency situations). A wireless controller from Auto Crane Company can be utilized for this purpose. The preferred hand-held device 140 has a handle 142, an antenna 144, a kill-switch 146, a monitor light 148, a call button 150 that will alert the operator in the cab, a belt loop connector 152 and various component controls 154. A conventional wireless receiver (not shown) is attached to the padding machine and conventionally wired to the various components that are to be controlled by the wireless unit 140. Of course, many other designs and features could be added to the remote device 140 and the padding machine to control additional functions. The receiver and control systems whereby the operations are controlled are conventional.

Figure 5:
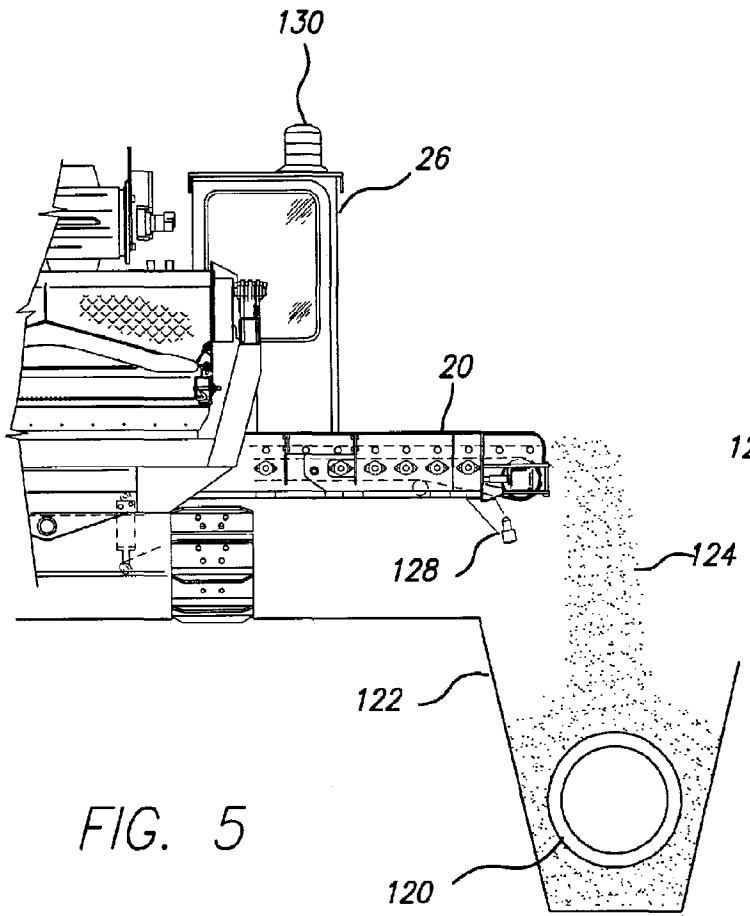
FIG. 5 is a partial rear view of the padding machine shown in operation adjacent to the trench, showing how the location of the operator's cab is adjacent to the trench.

The padding level monitoring system is best seen in FIGS. 5 and 6. FIG. 6 shows a side view of the machine during the padding operation in which a section of the pipe 120 has already been positioned in the trench 122 and is ready to be padded. The fines 124 are being delivered into the trench 122 from the cross-pass conveyor 20. The fines 124 flow completely around and under the pipe 120, and, depending on the degree to which the trench 122 is horizontal, the fines tend to flow a distance ahead of the location where the cross-pass conveyor 20 is dropping the fines 124.

As mentioned, the backfilling operation typically specifies that the fines 124 be piled a minimum distance above the highest point of the pipe 120. Therefore, it is important that the minimum amount of padding be added in a single pass, but it is also important that not too much be added. In order to monitor precisely the depth of fill on a real time basis, the distal end of the cross-pass conveyor 20 is outfitted with a pair of ultrasonic sensing devices 126 and 128. The sensors are attached so that sensor 126 is located a distance in front of, and sensor 128 is located a distance behind, the cross-pass conveyor 20 (relative to the intended movement of the padding machine during the padding operation). Sensor 126 is positioned and aimed so that during the padding operation it senses the distance between itself and the top of the pipe 120 in the trench 122. Sensor 128 is positioned and aimed so that it senses the distance between itself and the top of the padding that has been added to the trench 122. The Versa-Max Ultrasonic Sensors sold by McMaster Carr Co. have proven workable in the often very dusty environment of a padding operation.

The signals from the sensors 126 and 128 are sent to an electronic comparator (not shown) that determines the distance differential between them, and thus calculates the amount of padding on top of the pipe 120 in trench 122. MicroLogix 1000 Programmable Controllers can be utilized as the comparator. It can be preprogrammed by the operator with the minimum amount of padding called for in the specifications for the padding job. The output from the comparator can be trifurcated into three signals—one when the padding is detected as being less than the specified amount, one when the padding is detected as being within a specified acceptable depth range, and one when the depth exceeds the desired maximum. The signals are sent to and illuminate the assigned color on a monitoring light 130. For example, if the padding is too shallow, the red light would illuminate. A green light would illuminate if the depth of the padding was within the acceptable range, and the yellow light would illuminate when too much padding was detected. A similar light will be included in the operator's cab and could be sent to the assistant's wireless control. Therefore, whether the padding machine needed to go faster or slower, the correct rate of speed could be determined by the operator of the machine and so adjusted.

In another embodiment, the signal from the comparator could be transmitted to a conventional electronic device that controlled the forward speed of the machine so that it was automatically increased or decreased as the need arose.

As best seen in FIG. 20, in another embodiment of this invention, a screening plate 47 is attached to the auger frame 40 immediately behind the digging auger 42. The screening plate has holes of pre-determined size so that only material that can pass through the holes can be delivered to the up-conveyor 16, and hence to the screening assembly 18. Screening plates having different size holes can be selectively used.

Other improvements that can be incorporated include an extendable counterweight 33 that is attached to the mainframe 22. When the auger and frame assembly 14 is lifted, the counterweight 33 can be extended to maintain appropriate fore/aft balance for the machine. The weight 33 would normally be fully retracted in the padding mode.

Rather than the usual foot and lever controls that are used in tracked vehicles, this machine can be equipped with a joysticks 160 and 161, to control the tracks and the front digging auger, respectively, that operate similarly to the joystick control in an airplane, since these functions almost continually must be altered to deal effectively with the ever-changing material conditions. Utilizing the joystick controls, the operator will be able to deftly maneuver the machine in any direction and will be able to precisely control the operation of the front auger assembly and direction of travel of the machine.

Figure 14:
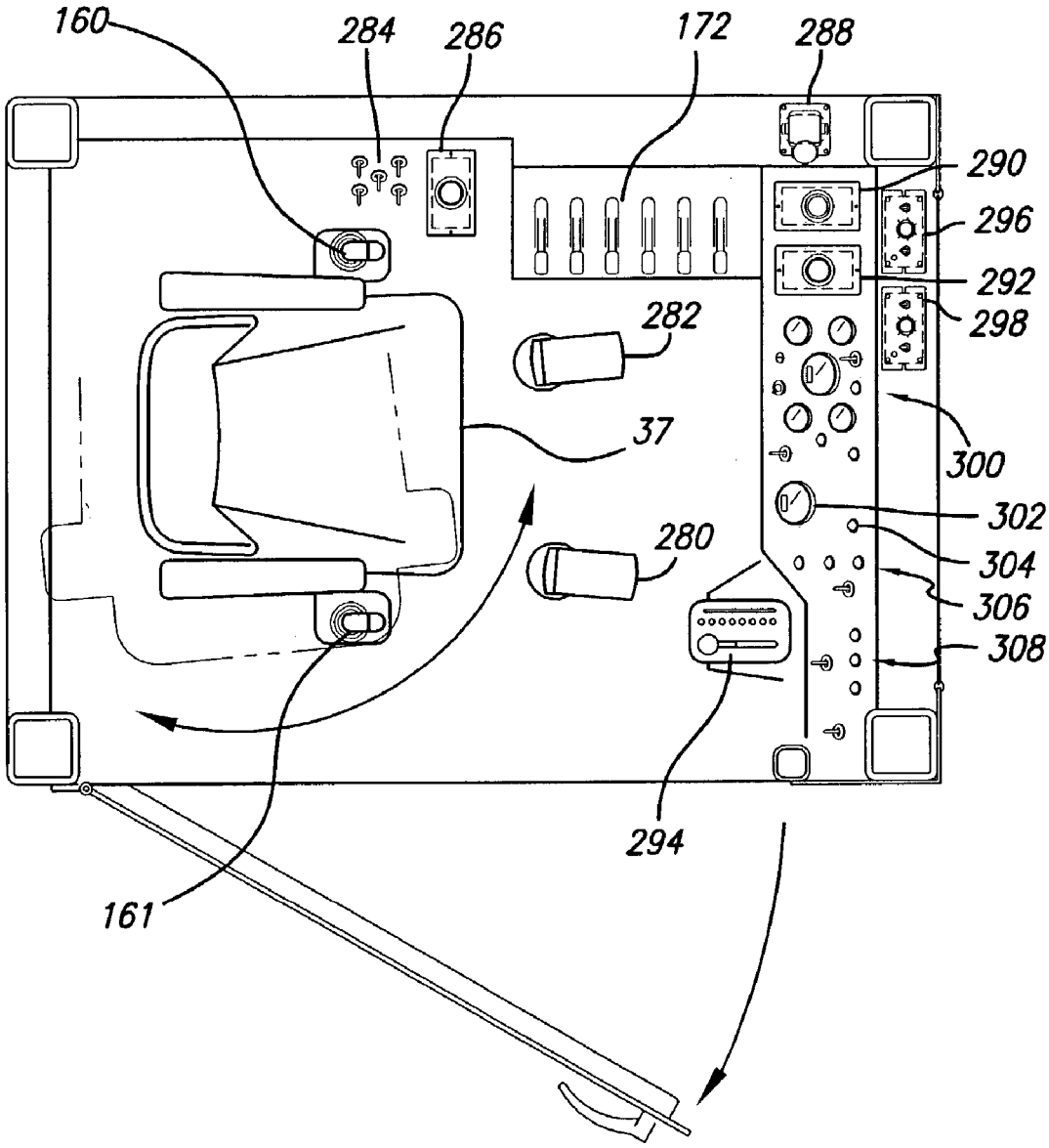
FIG. 14 is a sectional top view of the interior of the operator's cab, showing the preferred layout of the various controls, including the location on the arms of the chair of the two joy-stick controls for the tracks and the front auger assembly.

The location of the two joysticks is shown in FIG. 14, attached to the arm rests of the chair 37 for easy, ergonomic access.

Articulation of the auger and frame assembly 14 during the padding operation is of prime importance during the padding operation to meet the demands of the ever changing material being processed by the padding machine.

Many of the other functions of the machine, such as conveyor speed, engine speed, counter weight extension or retraction, will need only periodic adjustments, or are automatic during the padding operation. The elevation or descent of the up conveyor 16 and auger 42 for processing of more or less material will be controlled by a joystick 161 located immediately to the right of the operator.

This joystick 161 will be mounted in the same manner as the track control joystick 160, on the left side of operator chair 37. The preferred joystick 161 is a 2 quadrant proportional electrohydraulic servo valve control. The joystick itself will control two 4-way solenoid valves 165*a* and 165*b* and one on-off 2-position solenoid float valve 165*c* , as best seen in FIG. 22B.

When energized these valves respond to an electric current, in direct proportion to the amount of current up to the maximum of 24 V.D.C. The joystick itself will be spring centered (or return to neutral when the operator removes his hand). Movement of the joystick forward or reverse will cause the frame cylinders 54 to extend or retract, causing the auger and frame assembly 14 to rotate forward about pivot point 50 as best seen in FIG. 18 (thereby increasing the amount of "cut;" or backward thereby decreasing the amount of "cut"). Electrical solenoid valve 165*a* is placed into the hydraulic lines between the joystick-controlled valves and the cylinders 54 that control the rotatable position of the auger and frame assembly 42. The solenoid valve 165*c* is controlled by an on-off button on the joystick control. This solenoid valve will operate to allow the cylinders 91 to go into "float" mode in which there is neither up nor down pressure being applied to the assembly 42, but it is able to float along the ground surface. When these cylinders are in float the auger box rests on a skid plate 55 just aft of the auger and frame assembly 14.

This button actuates an electrically flip flop 2-position (spring to open, solenoid to close) electric switch. By pushing the button the solenoid closes the contacts, push this same button again the contacts open. This flip flop switch is electrically connected to the float solenoid valves 165*c*.

Figure 22A:
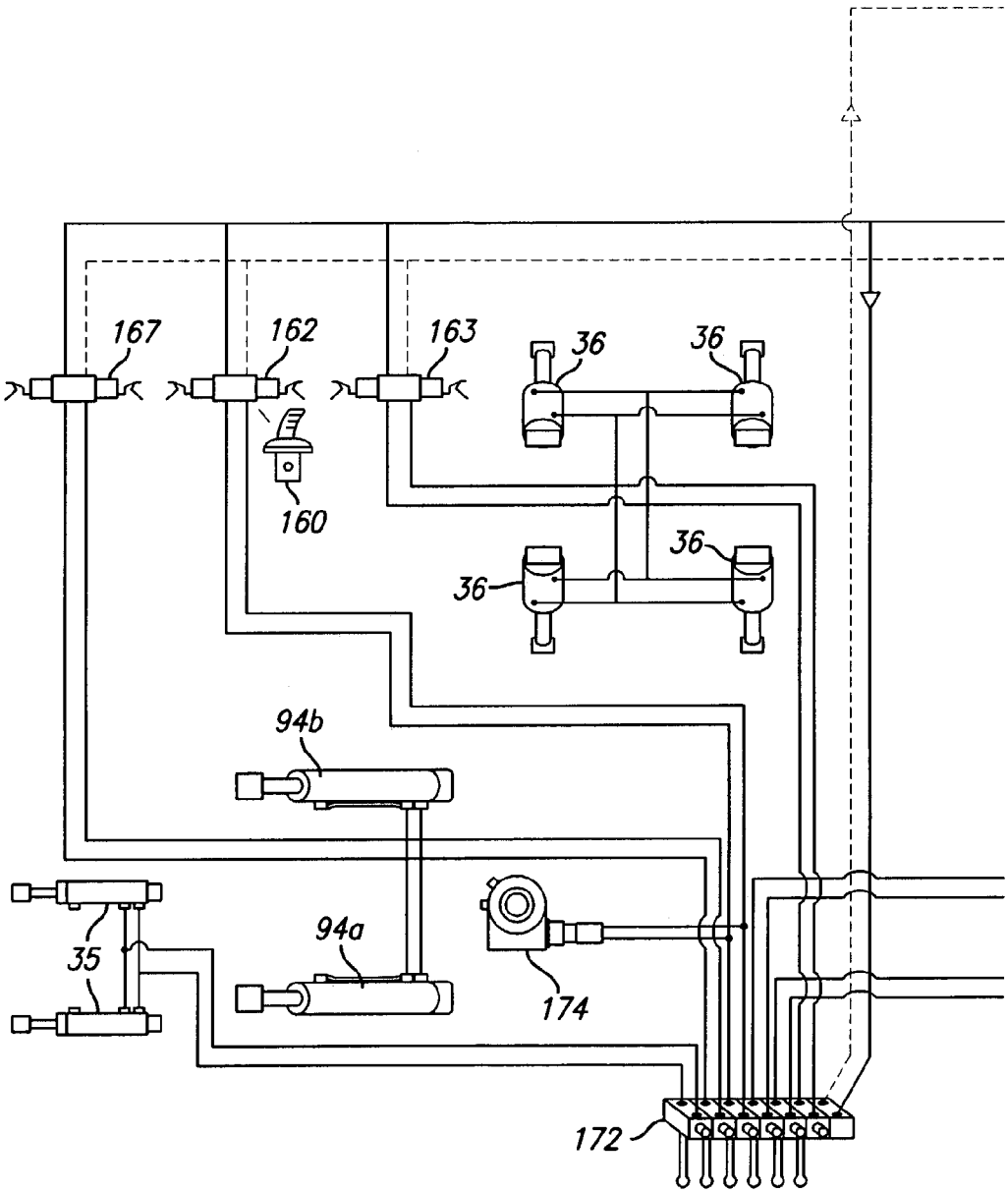
FIGS. 22A and B together form the schematic for the hydraulic circuit for the operator controls showing, among other things, how the joystick controls are integrated into the circuit for control of the tracks and for control of the articulation of the front auger and box assembly.
Figure 22B:
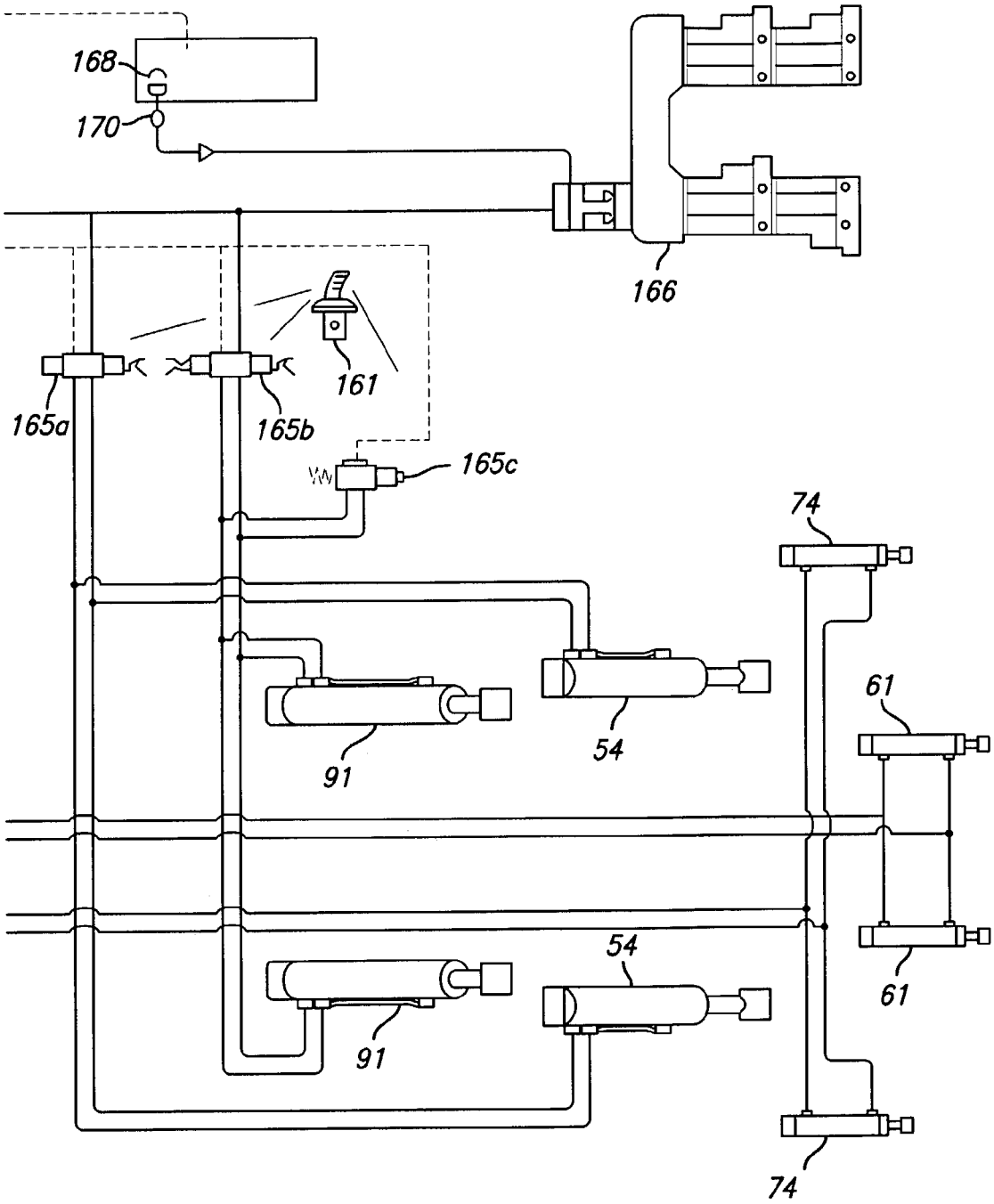

The hydraulic circuit for the articulation of the machine by the operator is shown in FIGS. 22A and B (which are to be considered together as each shows one-half of the overall system).

Joystick 161 is depicted, along with all of the various hydraulic cylinders and solenoid valves that control various aspects of the machines operation.

Atop joystick 160 is a 3 position toggle switch. Energizing the switch activates solenoid valve 162 to shift the conveyor left or right by gear box 174. The hydraulic system includes the conventional pump 166, tank 168, valve 170, and lever controls 172, and conveyor shift gear box 174.

The hydraulic circuit for the track drive is shown in FIG. 23, which includes the joystick control 160. The circuit includes the conventional components—oil cooler 180, thermal by-pass 181, the pumps 800, the charge pump filters 183, the tank 168, the lever controls 172, the filter/strainers 184, the cold start engine by-pass valve manifold 172, the operator variable speed forward and reverse control 160, the track drivers 187, and the heat stripper valves 188.

Figure 24:
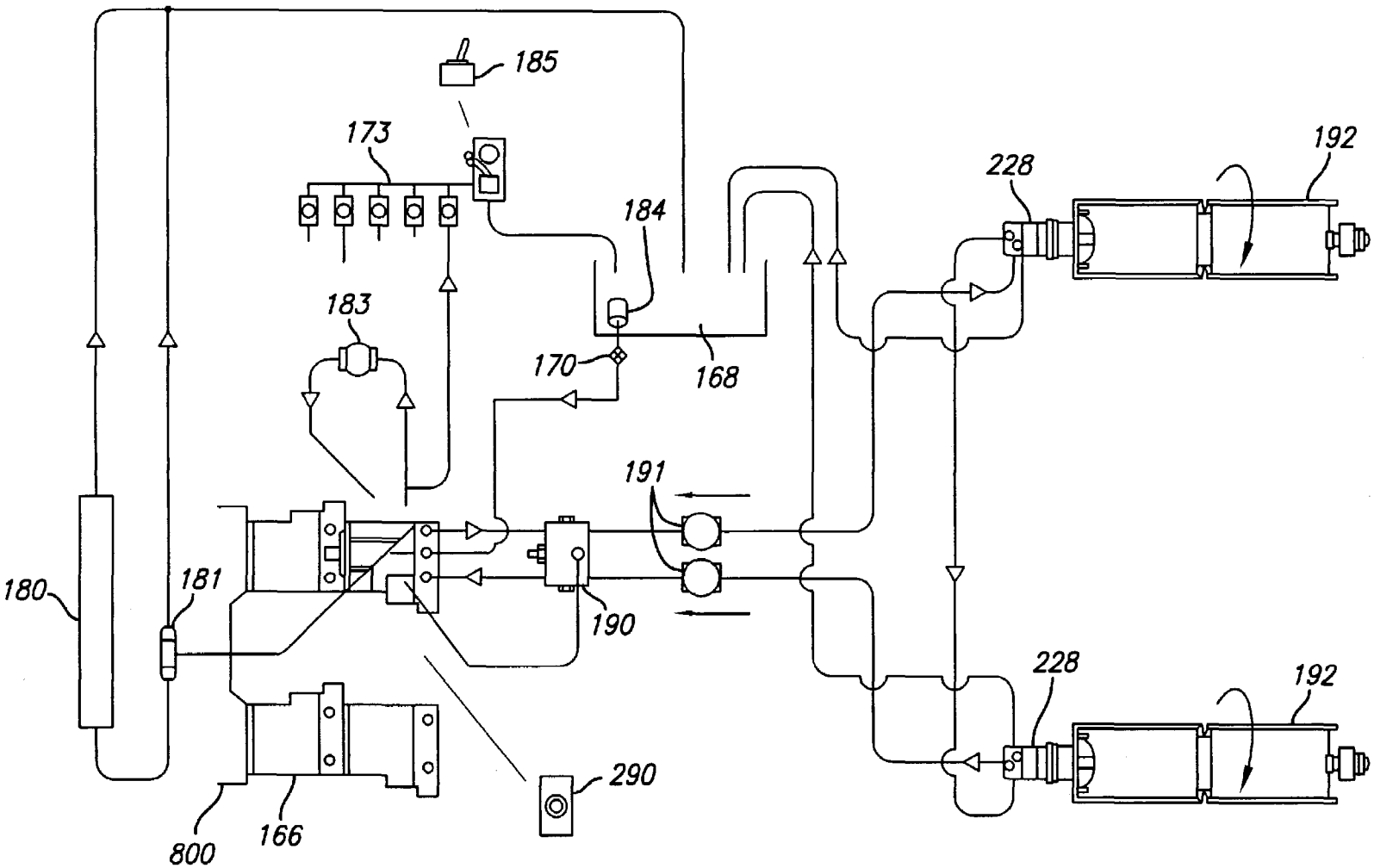
FIG. 24 is a schematic for the hydraulic circuit for the cross-pass conveyor system.

The hydraulic circuit for the cross-pass conveyor system is shown in FIG. 24, and includes the hot oil stripper valve 190, the filters 191, and the conveyor drive pulley assemblies 192.

Figure 25:
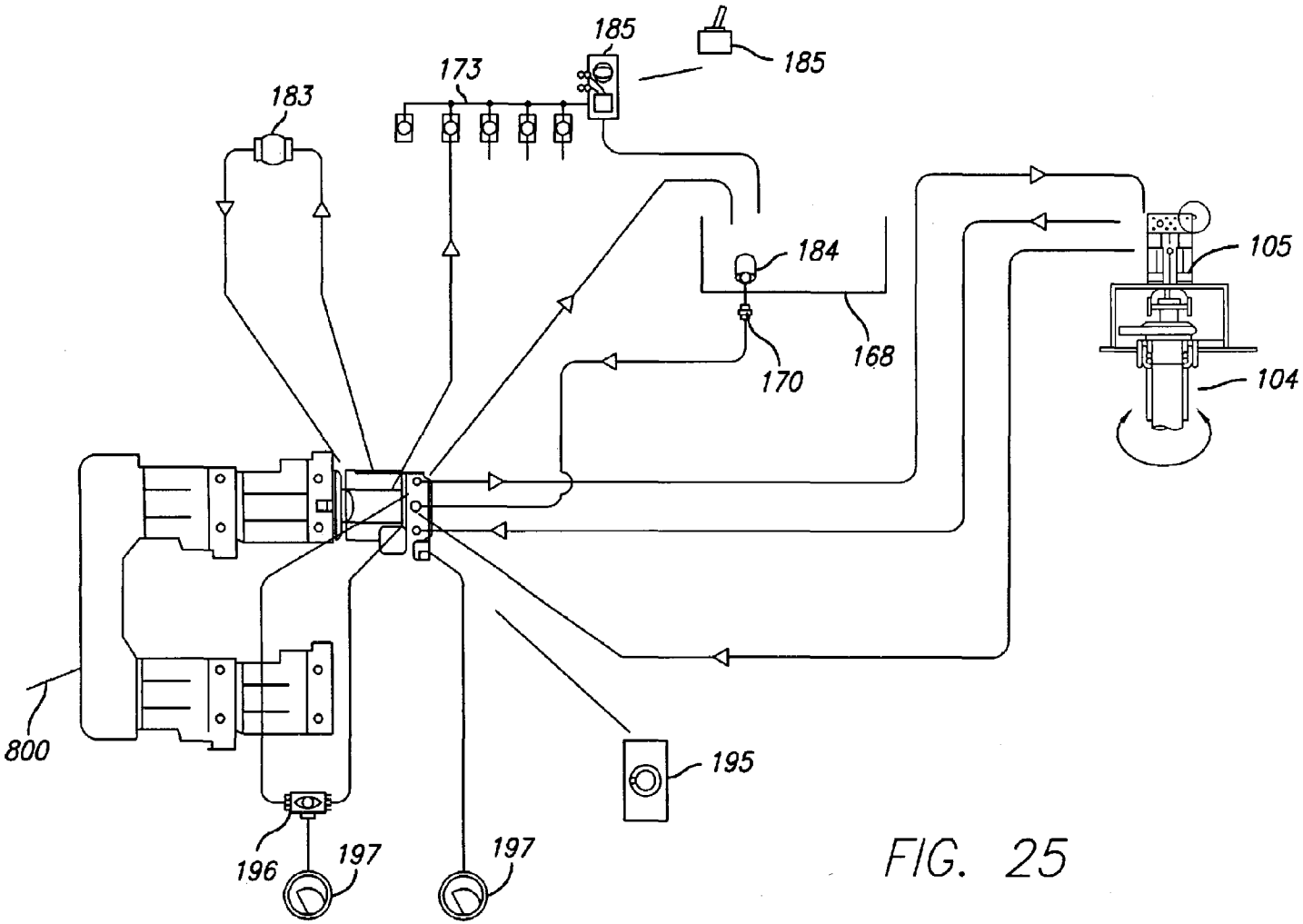
FIG. 25 is a schematic for the hydraulic circuit for the screen assembly.

The hydraulic circuit for the screen assembly is shown in FIG. 25, and includes the operator control 195, the eccentric cam 104, the shuttle valve 196, and the monitoring gauges 197.

Figure 26:
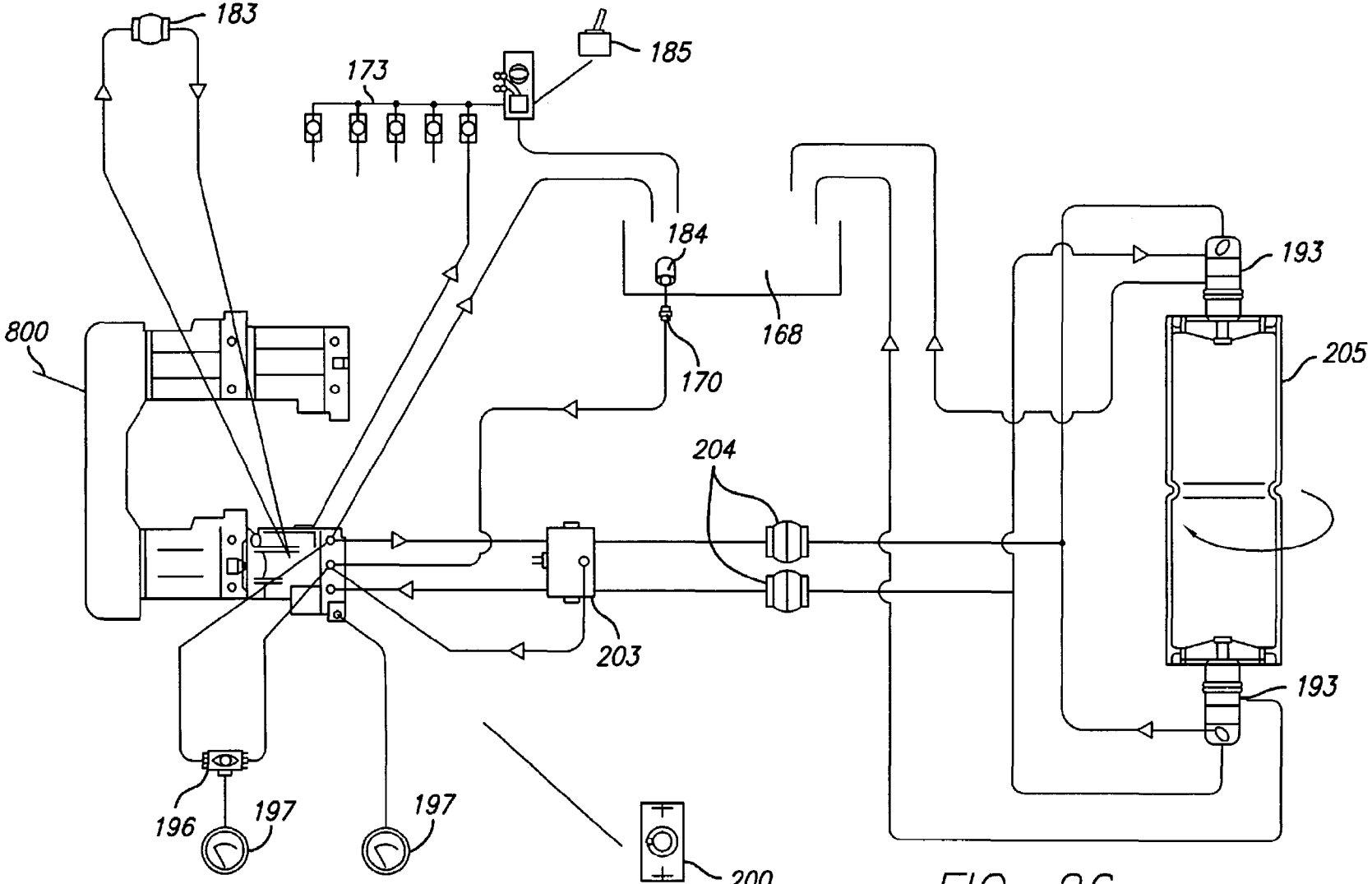
FIG. 26 is a schematic for the hydraulic circuit for the up conveyor assembly.

The hydraulic circuit for the up-conveyor is shown in FIG. 26, and includes the operator control 200, the monitoring gauges 201, a Sundstrand piston pump 202, and the belt drive pulley assembly 205.

Figure 27:
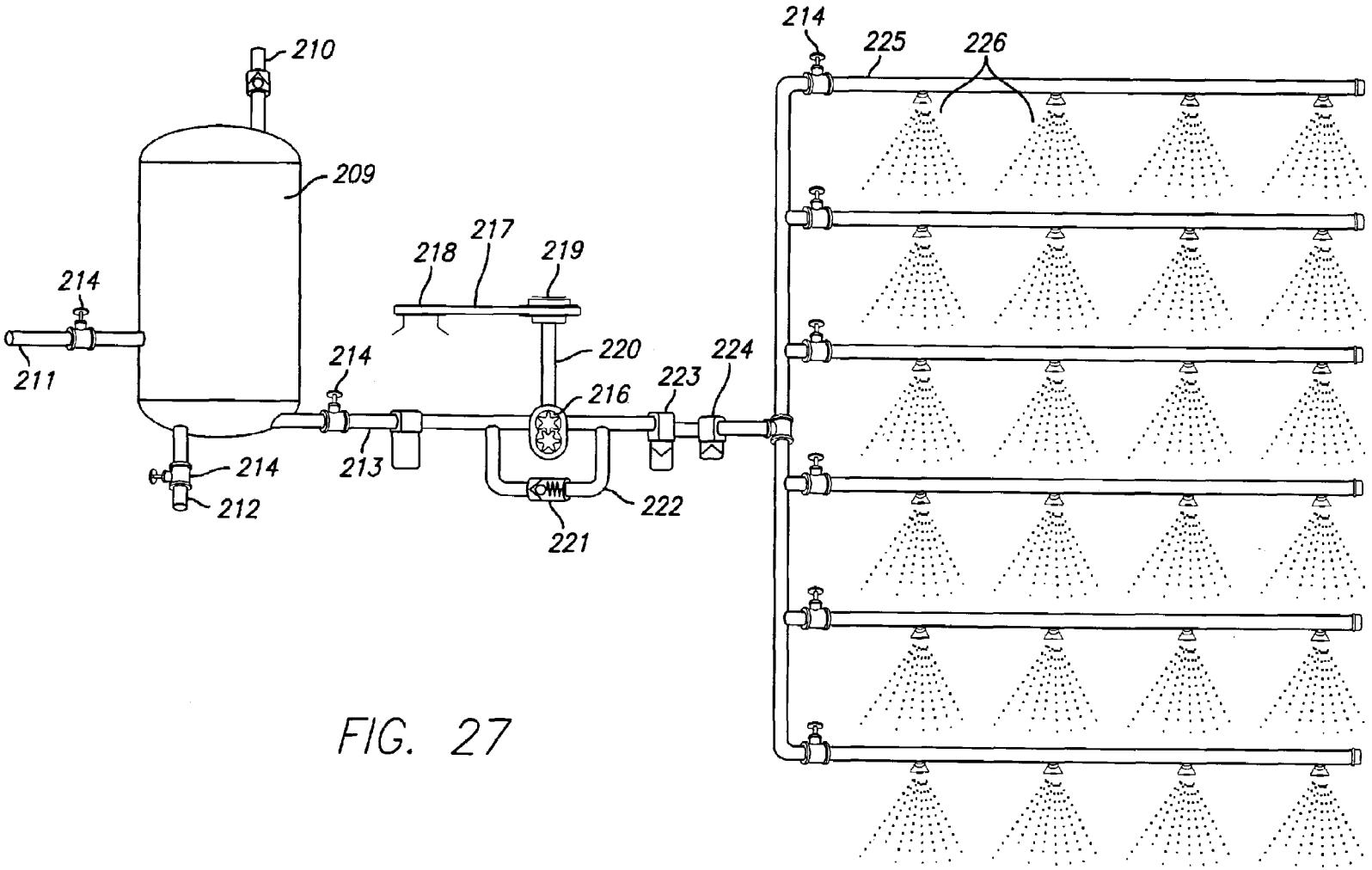
FIGS. 27 and 28A, B, and C all relate to the optional dust control and heating systems.

The dust control aspects of this invention are shown in FIGS. 27 and 28A B and C. FIG. 27 displays the main components of the system which are the tank 209 (preferably 250 gallons), the air vent 210, the fill line 211 by which the tank is filled from a water truck or other source, a drain line 212 to clean out the tank, and an outlet line 213. Each of the lines has a conventional manual on-off valve 214. A filter screen 215, preferably 125 mesh, is in the outlet line; upstream from the water pump 216, which is powered by means of a belt 217 that comes from a pulley 218 attached at one end to engine 12, and at the other end to an electric magnetic clutch 219 which is attached to the rotor 220 of the pump 216. A one-way check valve 221 is in a by-pass line 222, and two additional filters, 223 and 224 (each 50 mesh), downstream of the pump 216, and then a series of sprinkler lines 225, each of which has a manual on-off valve 214 and a number of sprinkler heads 226.

Figure 28C:
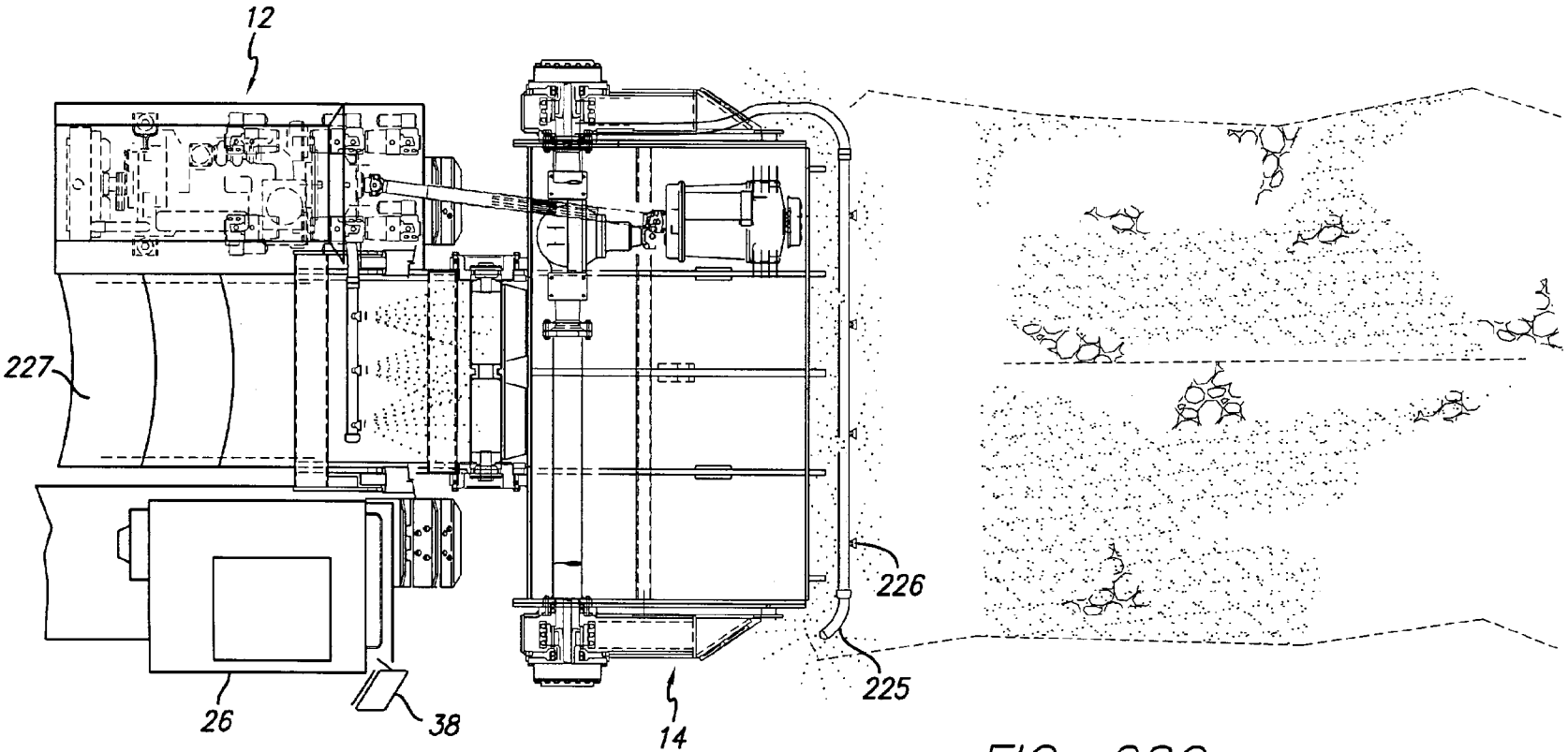

As shown in FIGS. 28A, 28B and 28C, the sprinkler lines 225 and heads 226 can be strategically placed to control dust at all areas where it is typically generated—in the trench, at the screen, on the up-conveyor and at the front auger. Dust hoods 230 can also be installed to further limit the production of dust.

In extremely cold, freezing conditions, the padding operation can be effectively brought to a standstill because any moisture in the spoil (even in extreme freezing conditions, only the exterior of the spoil bank will freeze, and the center will still be wet) will freeze on the screen. The machine can be equipped with a screen heat cover 227, a flex-tubing (not shown) that conveys heat from the engine exhaust system to the screen area. In extreme cold, a propane-fired burner (not shown) can be added to the system to provide additional heat. These will keep the screen warm, unplugged, and functional.

The preferred operator control lay out is shown in FIG. 14, wherein, in addition to the two joystick controls 160 and 161 for controlling the direction and speed of the tracks 24 and articulation of the auger box 40, respectively, there is a right foot engine decelerator pedal 280; a left foot pedal 282 to release the lock-up clutch 712; controls 284 for the cab compartment air conditioning; control 286 for the speed and direction of the cross-pass conveyor; the throttle 288 to control the RPM's of the engine 12; the control 290 for the speed and direction of the up conveyor 16; the control 292 for the shaker screen eccentric motor; the control 294 for the auger transmission 77; the automatic transmission (anti-stall) control 296 for the engine 12; the shaker screen motor and cross pass conveyor automatic speed control 298; various engine gauges and controls 300 (such as the tachometer, oil pressure, water temperature, voltage, warning light, air cleaner indicator, start/stop switch); the screen motor tachometer 302; the lock-up clutch slippage indicator 304; the screen leveling on-off switch and three indicator lights 306; the three machine leveling indicator lights and on-off switch 308. Not shown is the padding level indicator light that will be placed in easy view of the operator to advise the operator if the amount of padding on the pipe is correct or too much or too little. The various hydraulic valve lever controls 172 are for the breaker bar 72 (up or down); the front guard 56 (up or down); the counterweight 33 (extend or retract), and override controls for the screen tilt, machine level (side-to-side) and the cross-pass conveyor location (side-to-side).

Many modifications to the preferred embodiment described above are possible without departing from the inventive features of this device. Accordingly, this patent is not limited to the preferred embodiment set forth above, but is of the full scope and breadth of the following claims.

I claim:

1. A padding device for separating the fines from the spoil pile adjacent a trench and returning the fines to the trench, the device comprising:

a. a vehicle;

b. a digging auger attached to the front of said vehicle and designed and constructed to come into contact with the spoil pile or the ground beneath it, or both;

c. an up conveyor attached to said vehicle behind said digging auger;

d. a screen and cross conveyor frame rotatably attached to said vehicle for housing a screen assembly and a cross conveyor;

e. a screen assembly attached to said frame;

f. a cross-pass conveyor attached to said frame; and g. means for rotating said frame so that the screen assembly and cross-pass conveyor remain at their preferred orientation relative to the horizontal when the vehicle traverses up slopes and down slopes.

2. The invention of claim 1 in which said means for rotating said frame comprise hydraulic means.

3. The invention of claim 1 in which said means for rotating said frame comprise mechanical means.

4. The invention of claim 1 further comprising electronic sensing means that sense whether the vehicle is on level ground or an up-slope or down-slope, and adjusting means that change the orientation of the screening assembly and the cross-conveyor to maintain them in the desired orientation relative to horizontal so as to optimize the amount of fines that are extracted from the dirt and other material that is delivered to the screening assembly.

5. A padding device for separating the fines from the spoil pile adjacent a trench and returning the fines to the trench, the device comprising:

a. a vehicle;

b. an up conveyor attached to the vehicle;

c. a screen and cross-pass conveyor frame rotatably attached to the vehicle for housing a screen assembly and a cross-pass conveyor;

d. a screen assembly attached to the frame;

e. a cross-pass conveyor attached to the frame; and f. means for rotating said frame so that the screen assembly and cross-pass conveyor remain at their preferred orientation relative to the horizontal when the vehicle traverses up slopes and down slopes.

6. The invention of claim 5 in which said means for rotating the frame comprise hydraulic means.

7. The invention of claim 6 in which said hydraulic means comprise hydraulically operated and controlled extendable pistons attached at one end thereof to the vehicle and at the other end thereof to the frame.

8. The invention of claim 5 in which said means for rotating the frame comprise mechanical means.

9. The invention of claim 5 in which said means for rotating the frame comprise electro/mechanical means.

10. The invention of claim 5 further comprising electronic sensing means that sense whether the vehicle is on level ground or an up-slope or down-slope, and adjusting means that change the orientation of the screening assembly and the cross-conveyor to maintain them in the desired orientation relative to horizontal so as to optimize the amount of fines that are extracted from the dirt and other material that is delivered to the screening assembly.

* * * * *